US011975872B2

(12) United States Patent
Brizek et al.

(10) Patent No.: US 11,975,872 B2
(45) **Date of Patent: *May 7, 2024**

(54) STRETCH FILM DISPENSER FOR ORBITAL PALLET WRAPPERS

(71) Applicant: TAB Industries, LLC, Reading, PA (US)

(72) Inventors: Thomas A. Brizek, Reading, PA (US); Andrew G. Brizek, Reading, PA (US)

(73) Assignee: TAB Industries, LLC, Reading, PA (US)

( * ) Notice: Subject to any disclaimer, the term of this patent is extended or adjusted under 35 U.S.C. 154(b) by 295 days.

This patent is subject to a terminal disclaimer.

(21) Appl. No.: 17/346,956

(22) Filed: Jun. 14, 2021

(65) Prior Publication Data

US 2021/0300607 A1 Sep. 30, 2021

Related U.S. Application Data

(63) Continuation of application No. 15/937,040, filed on Mar. 27, 2018, now Pat. No. 11,066,198, which is a (Continued)

(51) Int. Cl.

| | |
|---|---|
| ***B65B 11/00*** | (2006.01) |
| ***B65B 11/02*** | (2006.01) |
| ***B65B 61/06*** | (2006.01) |

(52) U.S. Cl.

CPC ..... *B65B 11/008* (2013.01); *B65B 11/025* (2013.01); *B65B 61/06* (2013.01); (Continued)

(58) Field of Classification Search

CPC . B65B 11/008; B65B 61/06; B65B 2011/002; B65B 2210/18; B65B 11/025; (Continued)

(56) References Cited

U.S. PATENT DOCUMENTS 4,204,377 A * 5/1980 Lancaster ..... B65B 11/045 53/399

4,299,076 A 11/1981 Humphrey (Continued)

OTHER PUBLICATIONS

2008 Brochure for Yellow Jacket 110 Pallet Wrapper.

*Primary Examiner* — Hemant Desai
*Assistant Examiner* — Mobeen Ahmed
(74) *Attorney, Agent, or Firm* — Barley Snyder

(57) ABSTRACT

An orbital wrapping apparatus for wrapping a cargo in a stretch film is provided and generally includes a base frame, a circular ring assembly mounted on the base frame, a stretch film dispenser mounted on the circular ring assembly, and a cutting assembly mounted to the base frame and extending through an opening defined by the circular ring assembly. The stretch film dispenser includes a roll of stretch film dispensing the stretch film by rotation of the circular ring assembly, a subframe fixed to the circular ring assembly and the roll of stretch film is mounted on a loading assembly attached to the subframe, and a first feed roller and a second feed roller are mounted to a portion of the subframe that is movable between a first position adjacent to an axis extending through the first and second end caps and a second position spaced further apart from the axis. The cutting assembly is adapted to cut and hold the stretch film.

17 Claims, 29 Drawing Sheets

Related U.S. Application Data continuation-in-part of application No. 13/919,132, filed on Jun. 17, 2013, now abandoned.

(60) Provisional application No. 61/661,112, filed on Jun. 18, 2012.

(52) U.S. Cl.
CPC ..... *B65B 2011/002* (2013.01); *B65B 2210/18* (2013.01); *Y10S 83/922* (2013.01); *Y10S 83/924* (2013.01); *Y10T 83/6636* (2015.04); *Y10T 83/7487* (2015.04)

(58) Field of Classification Search
CPC .. Y10S 83/922; Y10S 83/924; Y10T 83/6636; Y10T 83/7487
USPC ..... 53/399, 441, 465, 556, 588, 210
See application file for complete search history.

(56) References Cited

U.S. PATENT DOCUMENTS 4,302,920 A 12/1981 Lancaster et al.
4,317,322 A * 3/1982 Lancaster ..... B65B 11/008 53/399
4,387,548 A 6/1983 Lancaster et al.
4,432,185 A * 2/1984 Geisinger ..... B65B 11/006 53/138.2
4,458,467 A * 7/1984 Shulman ..... B65B 11/045 53/399
4,545,182 A * 10/1985 McDowell, Jr. ..... B65B 13/10 53/556
4,549,388 A * 10/1985 Lancaster ..... B65B 51/225 53/210
4,563,863 A * 1/1986 Humphrey ..... B65B 11/045 53/556
4,712,354 A 12/1987 Lancaster et al.
4,723,393 A 2/1988 Silbernagel
4,761,934 A * 8/1988 Lancaster ..... B65B 11/025 53/399
4,953,336 A 9/1990 Lancaster et al.
4,995,224 A * 2/1991 Yourgalite ..... B65G 61/00 53/540
5,005,335 A * 4/1991 Yourgalite ..... B65B 11/045 53/399
5,027,579 A * 7/1991 Keip ..... B65B 11/008 53/412
5,203,136 A 4/1993 Thimon et al.
5,301,493 A 4/1994 Chen
5,311,725 A 5/1994 Martin et al.
5,414,979 A 5/1995 Moore et al.
5,450,709 A * 9/1995 Steding ..... B65B 11/025 53/399
5,606,849 A 3/1997 Bettenhausen
5,740,662 A * 4/1998 Royneberg ..... A01F 15/071 53/556
5,779,179 A * 7/1998 Zentmyer ..... B65B 67/085 242/596.5
5,799,471 A 9/1998 Chen
5,802,810 A * 9/1998 Wojcik ..... B65B 11/025 53/399
5,836,140 A 11/1998 Lancaster, III
5,875,616 A * 3/1999 Paavola ..... B65B 11/025 425/66
5,941,049 A * 8/1999 Lancaster, III ..... B65B 11/045 53/399
6,082,081 A * 7/2000 Mucha ..... B65B 11/00 425/66
6,253,532 B1 7/2001 Orpen
6,564,532 B2 5/2003 Gutche
6,698,161 B1 3/2004 Rossi
6,729,106 B2 5/2004 Wiley
6,742,322 B2 * 6/2004 Qicang ..... B65B 67/08 53/399
7,047,707 B2 * 5/2006 Lancaster, III ..... B65B 11/045 53/399
7,107,743 B2 * 9/2006 Suolahti ..... B65B 11/025 53/556
7,533,515 B1 * 5/2009 Koskela ..... B65B 11/025 53/556
7,568,327 B2 * 8/2009 Lancaster, III ..... B65B 11/025 53/210
7,581,368 B1 9/2009 Bison
7,779,607 B2 * 8/2010 Lancaster, III ..... B65B 11/025 53/399
7,908,830 B2 * 3/2011 Cousins ..... B65B 11/045 53/436
8,037,660 B2 10/2011 Lancaster
8,365,508 B2 * 2/2013 Kenney ..... B65B 13/04 53/399
8,607,538 B2 * 12/2013 Cere ..... B65B 11/025 53/389.2
8,695,312 B2 * 4/2014 Johnson ..... B65B 11/045 53/399
8,997,439 B2 * 4/2015 Ciou ..... B65B 11/045 53/389.2
9,108,753 B2 * 8/2015 Moore ..... B65B 11/008
9,290,285 B2 * 3/2016 Johnson ..... B65B 11/00
9,981,762 B2 * 5/2018 Chalmers ..... B65D 19/00
10,538,353 B2 * 1/2020 Terenzi ..... B65B 45/00
2003/0145563 A1 8/2003 Cere
2004/0031238 A1 2/2004 Cox
2005/0044812 A1 * 3/2005 Lancaster, III ..... B65B 41/16 53/399
2005/0050861 A1 * 3/2005 Suolahti ..... B65B 11/025 53/556
2006/0248858 A1 11/2006 Lancaster, III
2006/0254225 A1 * 11/2006 Lancaster, III ..... B29C 55/06 53/556
2006/0289691 A1 12/2006 Forni
2007/0204564 A1 * 9/2007 Lancaster, III ..... B65B 57/04 53/399
2008/0229707 A1 * 9/2008 Zitella ..... B65H 19/12 53/64
2009/0120307 A1 * 5/2009 Koskela ..... B65B 11/045 100/27
2009/0293435 A1 * 12/2009 Johnson ..... B65B 45/00 53/461
2010/0018165 A1 * 1/2010 Kudia ..... B65B 11/025 53/210
2010/0037562 A1 * 2/2010 Forni ..... B65B 51/00 53/461
2011/0179752 A1 * 7/2011 Lancaster, III ..... B65B 11/008 53/556
2014/0250833 A1 9/2014 Piani
2015/0151861 A1 * 6/2015 Chalmers ..... B65B 11/045 53/389.2
2017/0057677 A1 * 3/2017 Terenzi ..... B65B 11/045

* cited by examiner

Fig. 4
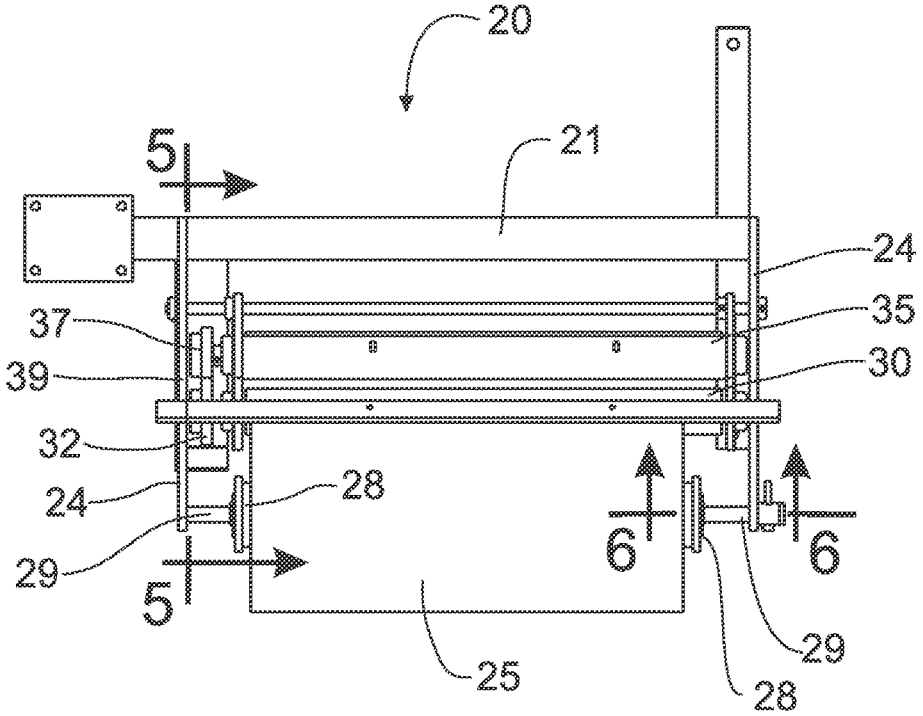
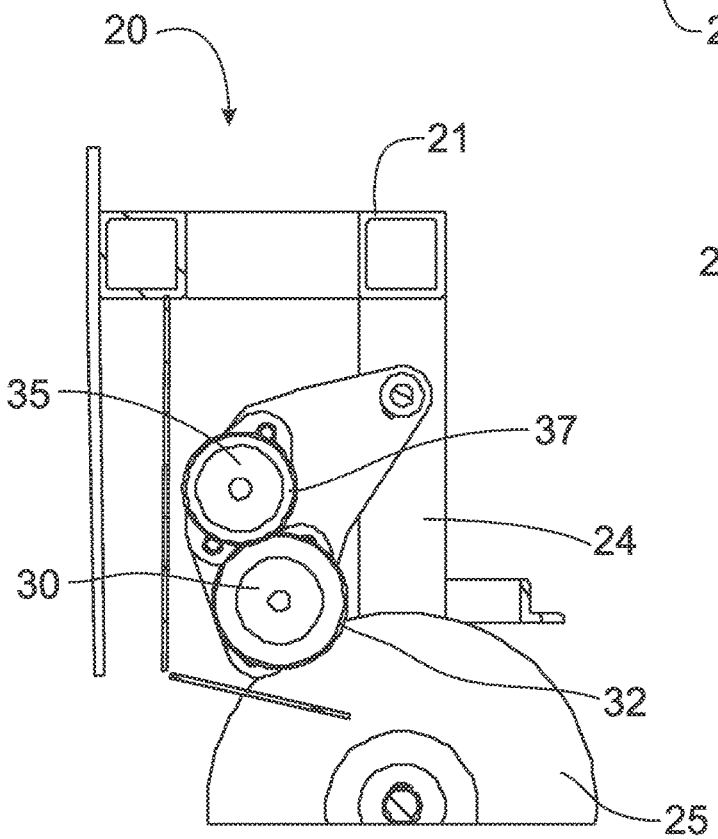
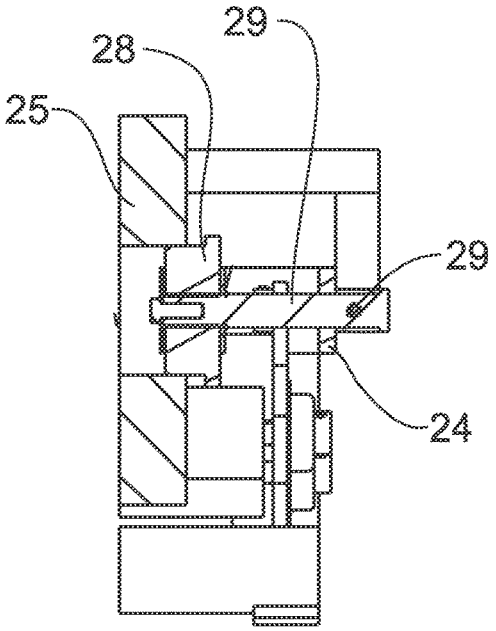
Fig. 5
Fig. 6

Fig. 9
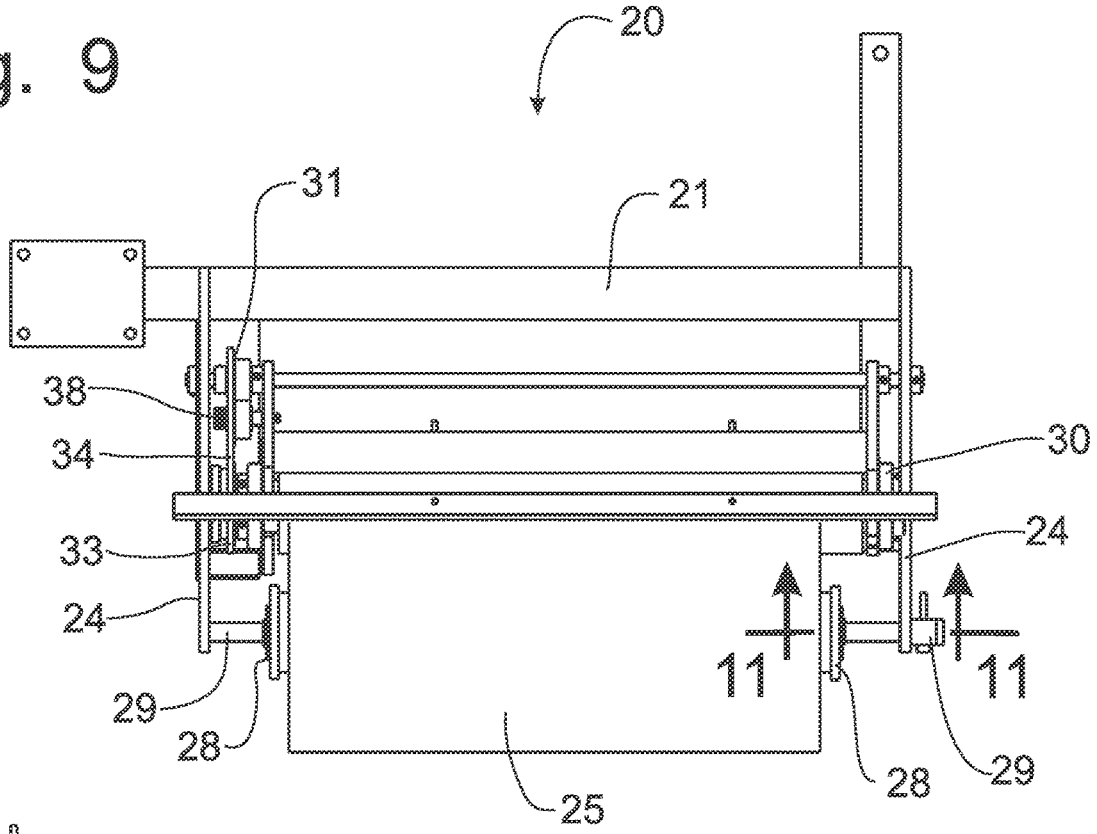
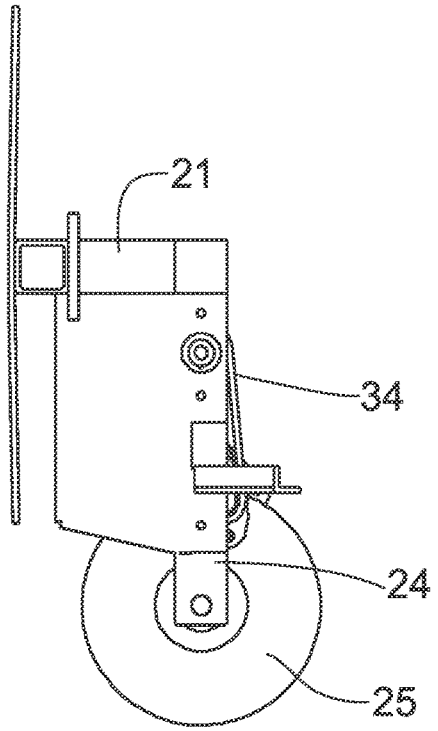
Fig. 10
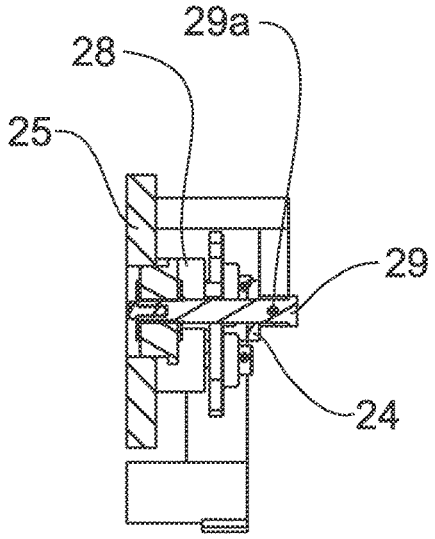
Fig. 11

Fig. 14
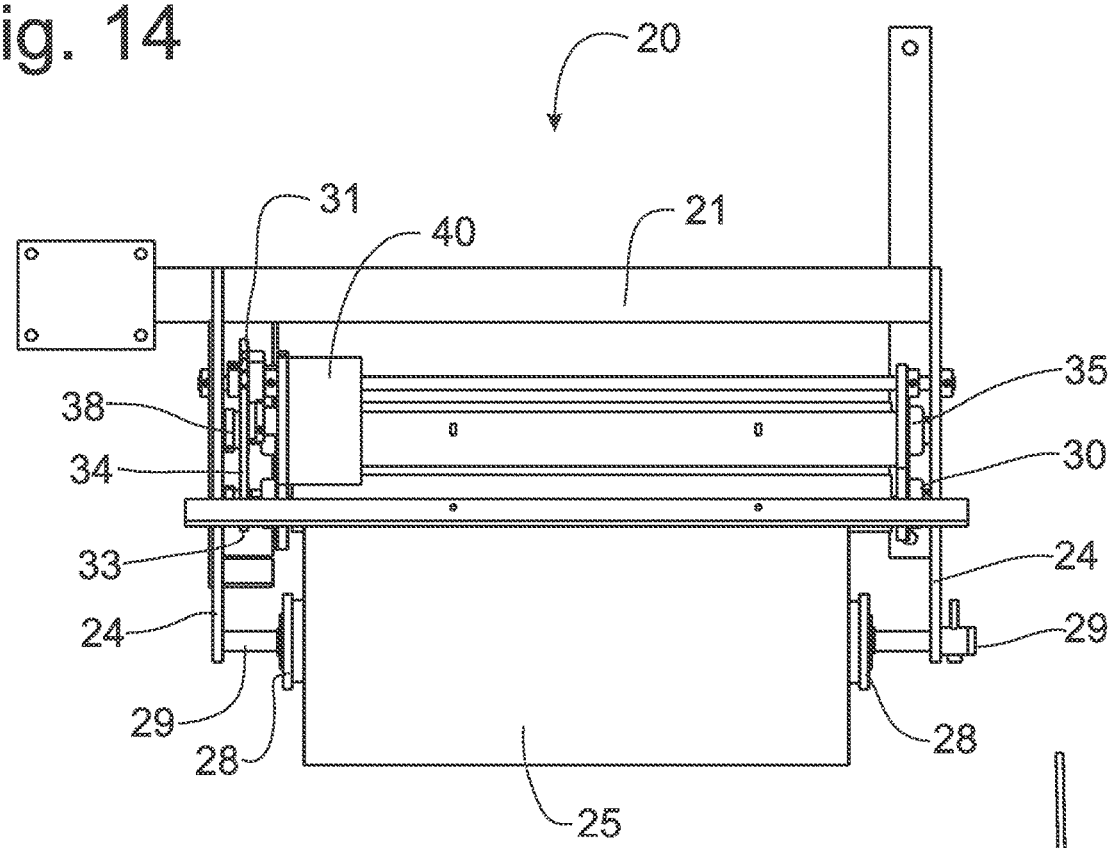
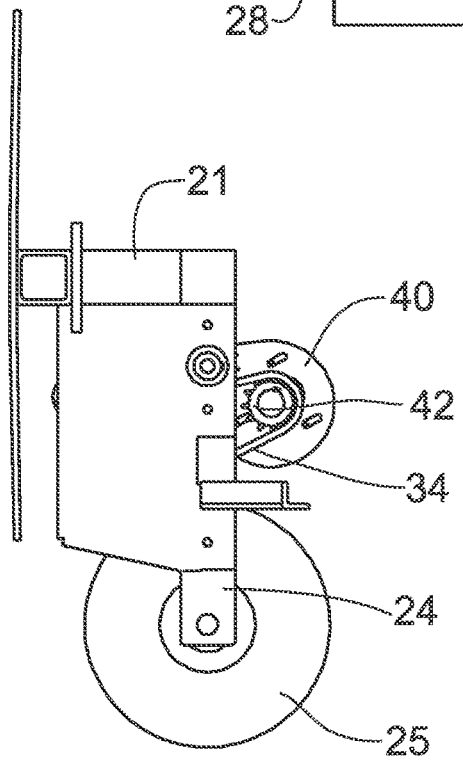
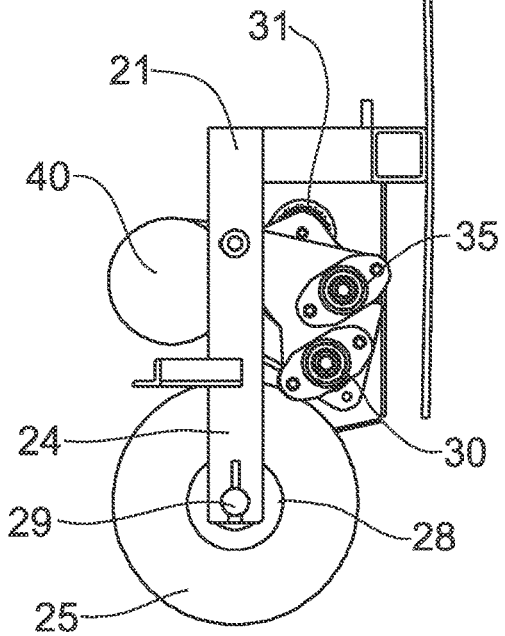
Fig. 15
Fig. 16

STRETCH FILM DISPENSER FOR ORBITAL PALLET WRAPPERS

CROSS-REFERENCE TO RELATED APPLICATIONS

This application is a continuation of U.S. patent application Ser. No. 15/937,040, filed on Mar. 27, 2018 that is a continuation-in-part of U.S. patent application Ser. No. 13/919,132, filed on Jun. 17, 2013, which claims the benefit of U.S. Provisional Patent Application No. 61/661,112, filed on Jun. 18, 2012.

FIELD OF THE INVENTION

This invention relates generally to the wrapping of a palletized load of products with stretch film and, more particularly, to an orbital wrapping mechanism that wraps stretch film around the pallet and the load placed on the pallet.

BACKGROUND

Wrapping stretch film around a cargo before shipment has been utilized for many years. The plastic film binds the products into a stable, more secured load that can be easily shipped from the manufacturing source of the products to the end user. Generally, the wrapped cargo is sized to be placed onto a pallet that facilitates the handling of the cargo during transportation and during the movement from one location to another.

Stretch film wrapping devices have traditionally been utilized to place stretch film around the cargo on the pallet. To this end, some stretch film wrapping machines place the cargo onto a rotating turntable while the roll of plastic stretch film, which is oriented vertically, is held in a stationary position for the application of the stretch film as the cargo is rotated on the turntable. One such apparatus can be found in U.S. Pat. No. 4,299,076, granted on Nov. 10, 1981, to John R. Humphrey, in which the cargo is placed onto a pallet and then moved along a horizontal roller conveyor to reach the turntable where the plastic film is applied as the pallet and the load thereon is rotated about a vertical axis. Another such wrapping apparatus is found in U.S. Pat. No. 5,606,849, granted to Roger V. Bettenhausen on Mar. 4, 1997. The vertically oriented roll of plastic stretch film is vertically movable to facilitate the application of the stretch film to the entire vertically oriented faces of the palletized cargo as the turntable is rotated.

Another more commonly found configuration of the stretch film wrapping mechanism has the cargo placed on the pallet which is held in a stationary position while the orbital wrapping apparatus rotates around the cargo to apply plastic stretch film to the vertically oriented faces of the palletized cargo. One example of such a wrapping machine can be found in U.S. Pat. No. 6,253,532, issued on Jul. 3, 2001, to Kenneth S. E. Orpen, in which the vertically oriented roll of plastic stretch film is carried on an arm that is rotated about a vertical axis of rotation carried by the apparatus and positioned over top of the cargo to be wrapped. In the Orpen wrapper apparatus, the cargo is anticipated to be in a cylindrical shape which is also rotated about a horizontal axis while the plastic stretch film is being applied to the cargo. The end result is that the entire cylindrical object is wrapped with the plastic stretch film. Such wrapping devices are commonly found in the agricultural industry to wrap cylindrical bales of hay or other organic material to create an airtight seal that converts the organic material into a silage product.

A variation of the stretch film wrapping machines having vertically oriented rolls of stretch film can be found in U.S. Pat. No. 7,581,368, granted to Darrel Bison on Sep. 1, 2009, and in U.S. Pat. No. 8,037,660, issued to Patrick R. Lancaster, III, et al, on Oct. 18, 2011. In these alternative wrapping machines, the plastic is applied as a rope that is passed around the vertically oriented faces of the cargo being secured and stabilized thereby. For some forms of cargo to be wrapped into a stabile shippable configuration, the consolidation of the stretch film into a rope configuration provides adequate stabilization of the cargo.

An orbital variation of the plastic stretch film wrapping mechanism can be found in U.S. Pat. No. 4,723,393, issued on Feb. 9, 1988 to Peter Silbernagel, wherein the plastic stretch film is applied around the cargo from a generally horizontally oriented roll of stretch film that is passed vertically around the cargo to be stabilized for shipment. In the '393 patent, the cargo being wrapped in plastic is wrapped while being passed through the center of the wrapping mechanism, the wrapped cargo being subsequently shipped with or without the use of a pallet. The orbital wrapping mechanism is operated within a gap formed in a horizontal conveyor along which the cargo is passed to be wrapped in stretch film.

The orbital wrapping apparatus shown in U.S. Pat. No. 6,564,532, issued to Robert J. Gutche on May 20, 2003, has the horizontally oriented roll of stretch film mounted on an arm that is rotated about the cargo and pallet being wrapped in plastic. The wrapping mechanism in the '532 patent is configured substantially like the vertical axis wrappers as depicted in U.S. Pat. No. 6,253,532, except oriented with the axis of rotation of the arm carrying the roll of plastic stretch film being positioned horizontally. A significant difference between the orbital wrapping apparatus shown in U.S. Pat. No. 4,723,393 and the wrapping mechanism shown in U.S. Pat. No. 6,564,532 is that the apparatus in U.S. Pat. No. 6,564,532 wraps stretch film around both the cargo and the pallet on which the cargo is situated.

A commercially available stretch film wrapping mechanism of the orbital configuration is marketed under the brand of "Yellow Jacket". This "Yellow Jacket" orbital wrapping mechanism has a base frame supporting a cylindrical wrapping mechanism that is linearly movable along the base frame. Within the cylindrical wrapping mechanism is an orbital wrapper that carries a roll of plastic stretch film positioned horizontally. The plastic roll is then driven around the cylindrical wrapping mechanism to dispense plastic stretch film around the cargo and the pallet on which the cargo is mounted. Typically, the pallet bearing the cargo is carried by a forklift in a manner that the cargo bearing pallet is positioned in the center of the cylindrical wrapping mechanism. The orbital drive is actuated to spin the roll of plastic stretch film around cargo and pallet and apply the stretch film thereto. The cylindrical wrapping mechanism is then moved along the base frame so that the plastic stretch film is applied along the entire longitudinal length of the cargo and pallet. The end result is that the cargo is secured directly to the pallet to provide stability and security to the wrapped cargo.

One of the difficulties in applying plastic stretch film around the cargo, whether or not the pallet is wrapped in plastic stretch film with the cargo, is that the stretch film is not placed in tension as the stretch film is being applied to the cargo. Although an adequate number of layers of the plastic film will ultimately resolve the stability problem inherent with a loose application of the stretch film to the cargo, more plastic stretch film is applied than is necessary to provide proper stability and security to the wrapped cargo.

Thus, it would be desirable to provide a plastic stretch wrap dispensing mechanism that would place tension on the stretch film as the plastic stretch film is being applied to the cargo. The end result is that less plastic stretch film would be required to stabilize a cargo being wrapped and less time would be needed to apply the stretch film to wrap and stabilize a cargo for shipment.

It would also be desirable to provide an orbital stretch film wrapping machine that is less expensive to manufacture while providing the end results of a wrapped, stabilized cargo bearing pallet.

SUMMARY

An orbital wrapping apparatus for wrapping a cargo in a stretch film is provided and generally includes a base frame, a circular ring assembly mounted on the base frame, a stretch film dispenser mounted on the circular ring assembly, and a cutting assembly mounted to the base frame and extending through an opening defined by the circular ring assembly. The stretch film dispenser includes a roll of stretch film dispensing the stretch film by rotation of the circular ring assembly, a subframe fixed to the circular ring assembly and the roll of stretch film is mounted on a loading assembly attached to the subframe, and a first feed roller and a second feed roller are mounted to a portion of the subframe that is movable between a first position adjacent to an axis extending through the first and second end caps and a second position spaced further apart from the axis. The cutting assembly is adapted to cut and hold the stretch film.

BRIEF DESCRIPTION OF THE DRAWINGS

The invention will now be described by way of example with reference to the accompanying figures, of which:

FIG. 4 is a rear elevational view of the dispensing apparatus shown in FIG. 4;

FIG. 5 is a cross-sectional view of the dispensing apparatus corresponding to lines 5-5 of FIG. 4 to shown the intermeshing gears of the two feed rollers;

FIG. 6 is a partial cross-sectional view of the end cap for the roll of stretch film to depict the rotational mounting thereof corresponding to lines 6-6 of FIG. 4;

FIG. 9 is a rear elevational view of the dispensing apparatus shown in FIG. 7;

FIG. 10 is a right side elevational view of the dispensing apparatus shown in FIG. 9;

FIG. 11 is a partial cross-sectional view of the end cap for the roll of stretch film to depict the rotational mounting thereof corresponding to lines 11-11 of FIG. 9;

FIG. 14 is a rear elevational view of the dispensing apparatus shown in FIG. 12;

FIG. 15 is a right side elevational view of the dispensing apparatus shown in FIG. 14;

FIG. 16 is left side elevational view of the dispensing apparatus shown in FIG. 14;

DETAILED DESCRIPTION OF THE EMBODIMENT(S)

Figure 1:
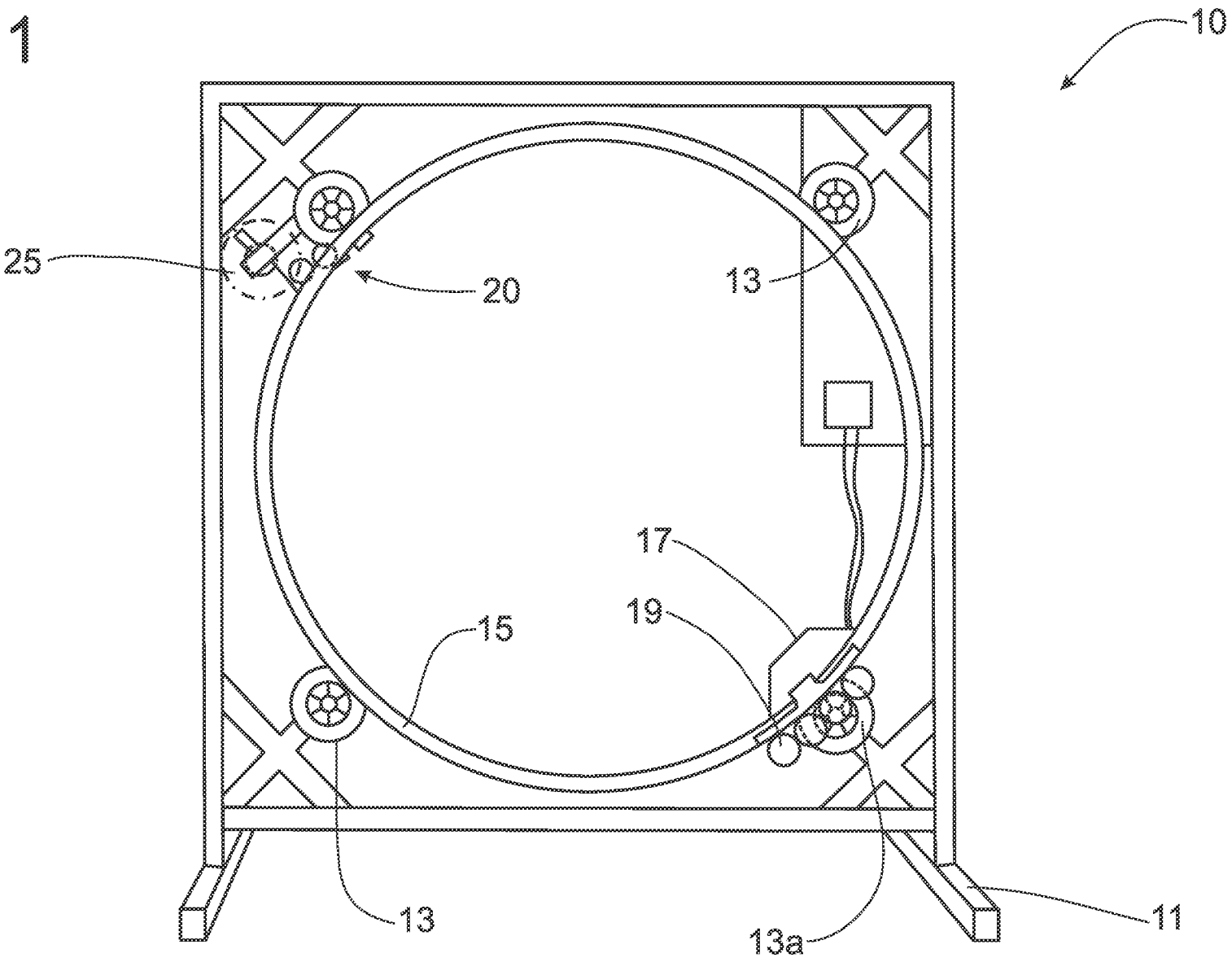
FIG. 1 is a schematic front elevational view of an orbital stretch film wrapping mechanism incorporating the principles of the instant invention, the safety guards being deleted from the drawing for purposes of clarity, the stretch film dispensing apparatus being shown in the upper right quadrant of the elevational view.

Referring first to FIG. 1, a stretch film wrapping mechanism incorporating the principles of the instant invention can best be seen. The orbital wrapping apparatus 10 is formed with a base frame 11 operable to support the orbital wrapping apparatus 10 on a floor surface. The base frame 11 supports a circular ring assembly 15 that is rotationally mounted on the base frame 11. A plurality of rotational supports 13, preferably in the form of rubber tires, are mounted on the base frame 11 to rotatably support the circular ring assembly 15. Preferably, one rotational support 13 is located at each corner of the base frame 11 mounted on a gusset spanning across the corner of the base frame 11. Three of the rotational supports 13 are idlers that simply support the rotational movement of the circular ring assembly 15. The fourth rotational support 13*a* is rotatably driven by an electrical motor 17 to power the rotation of the circular ring assembly 15.

A stretch film dispenser 20 is mounted in a cantilevered manner on the circular ring assembly 15 so as to not interfere with the rotational support of the circular ring assembly 15 by the rotational supports 13, 13*a*. A counterweight 19 is also mounted on the circular ring assembly 15 diametrically opposite the mounting of the stretch film dispenser 20 so that the rotation of the circular ring assembly 15 with the stretch film dispenser 20 mounted thereon can be balanced. Alternatively, a second stretch film dispenser could be supported on the circular ring assembly 15 in diametric opposition to the first stretch film dispenser 20 instead of the counterweight 19.

The circular ring assembly 15 carrying the stretch film dispenser 20 is powered to rotate relative to the base frame 11. The circular ring assembly 15 does not move longitudinally relative to the base frame 11; therefore, the stretch film supplied by the stretch film dispenser 20, as will be described in greater detail below, will only be applied in a single swath to the cargo inserted into the orbital wrapping apparatus 10. Thus, the construction of the orbital wrapping apparatus 10 is substantially simplified without providing a track on the base frame 11 that would support a longitudinal movement of the circular ring assembly 15 in order to apply the stretch film to the cargo in longitudinally spaced swaths or in a spiral manner. The application of stretch film to the cargo to be wrapped can be accomplished by moving the cargo relative to the circular ring assembly 15, as will be described in greater detail below.

Figure 2:
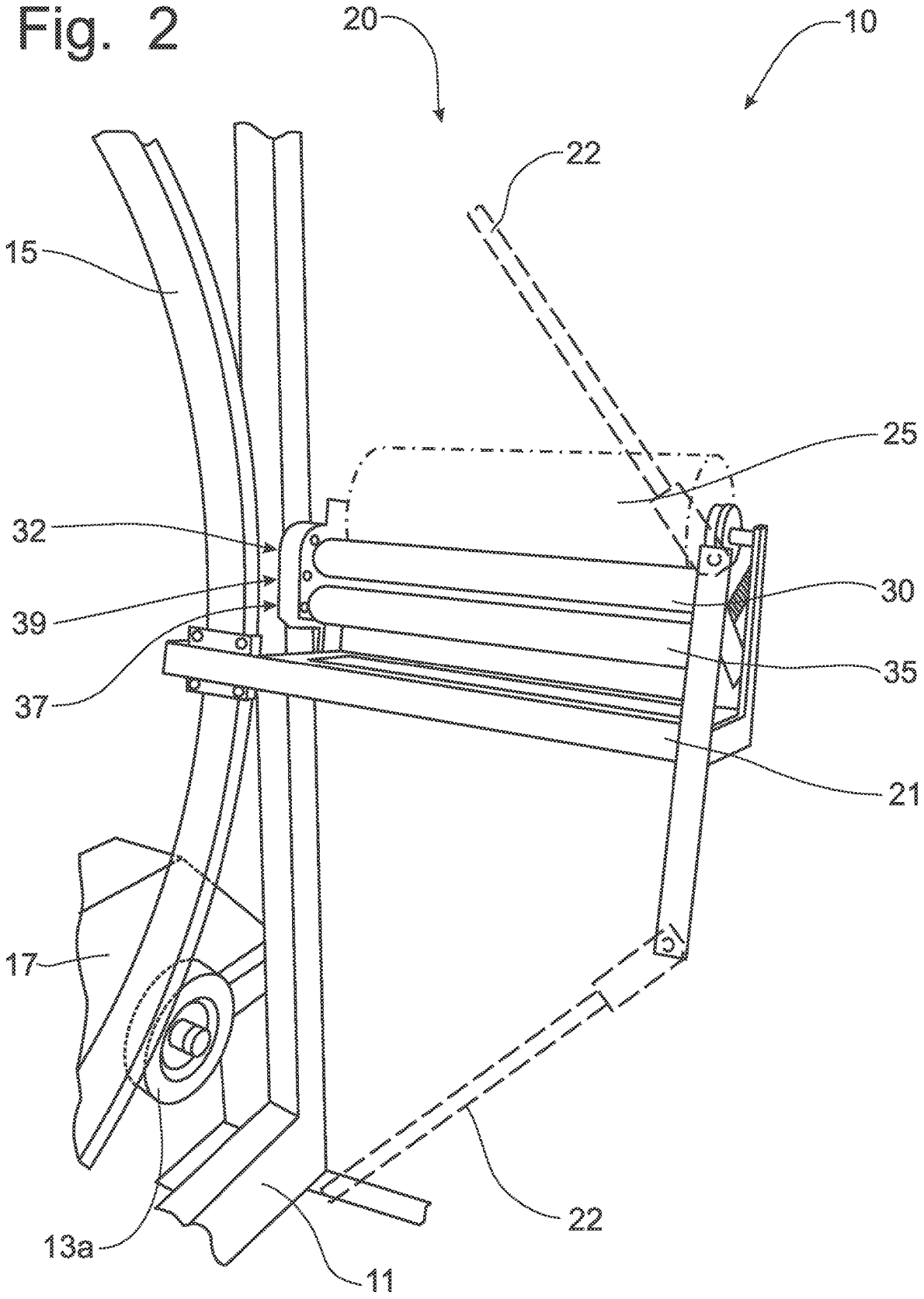
FIG. 2 is a schematic perspective view of the dispensing apparatus of the orbital stretch film wrapping mechanism shown in FIG. 1 for applying stretch film to a cargo supported on a pallet.
Figure 3:
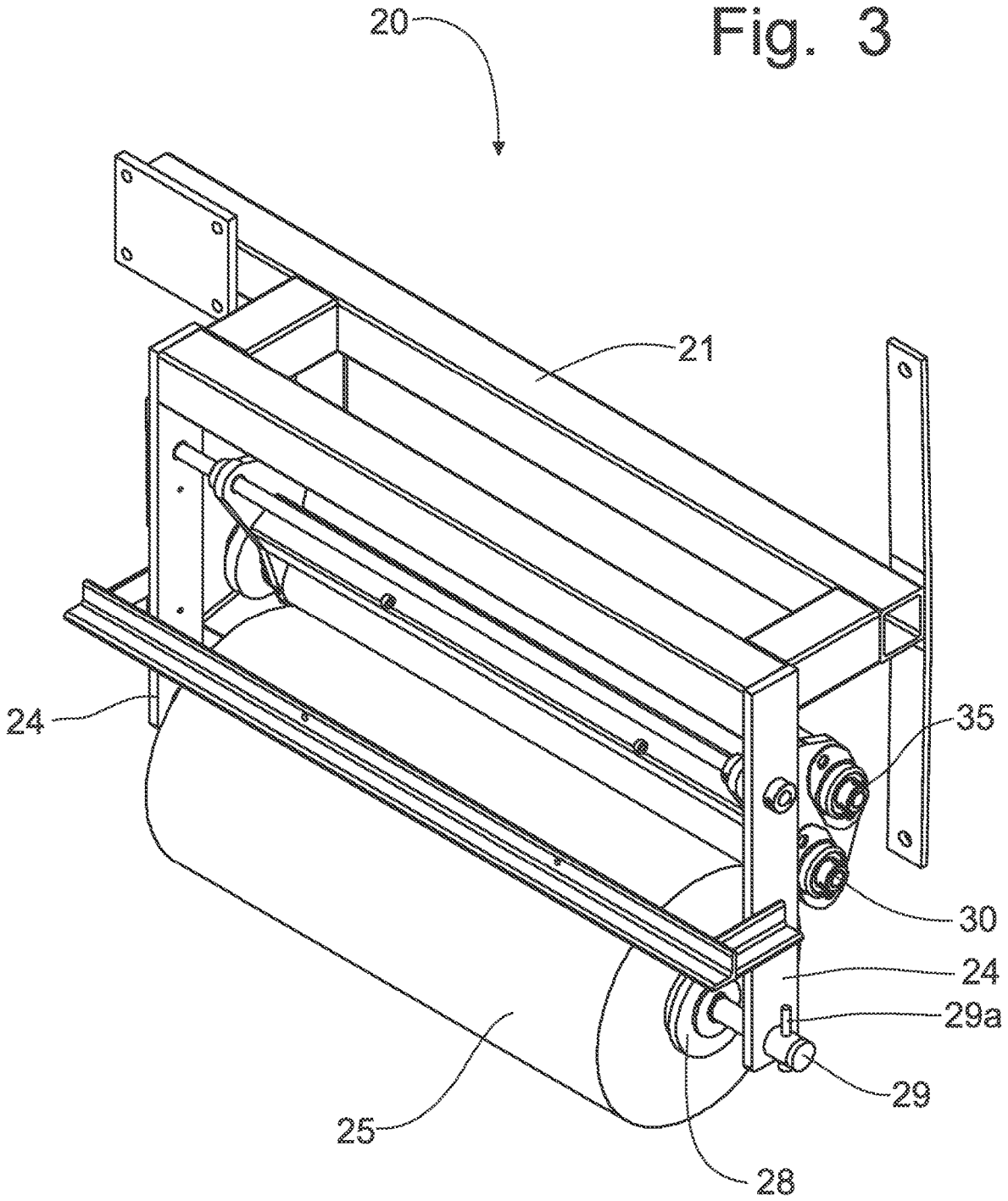
FIG. 3 is a back side perspective view of a first embodiment of the dispensing apparatus utilizing intermeshing gears for use on a wrapping mechanism such as depicted in FIG. 1.
Figure 7:
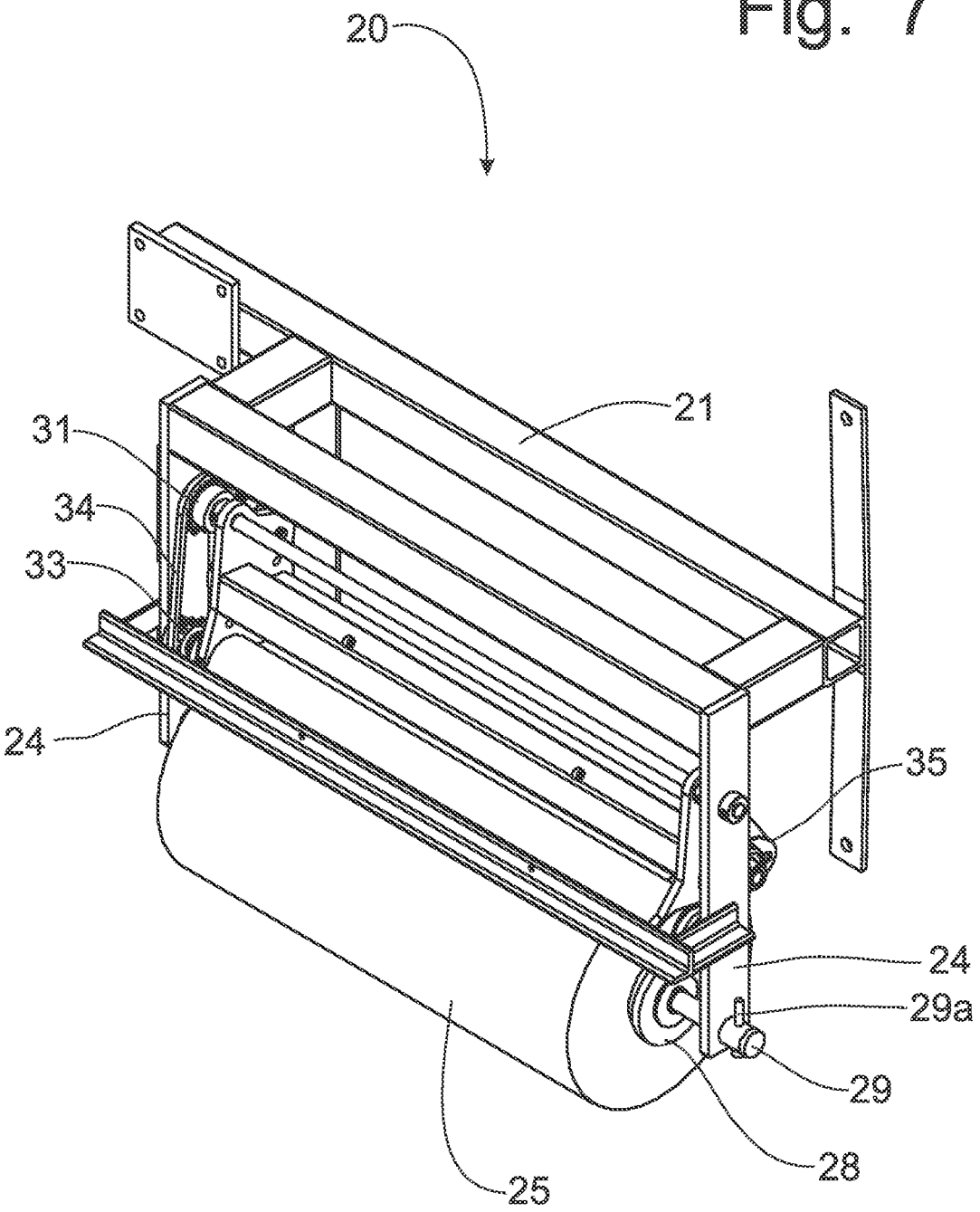
FIG. 7 is a left rear side perspective view similar to that of FIG. 3, but depicting a second embodiment of the dispensing apparatus utilizing a chain drive interconnecting the feed rolls for use on a wrapping mechanism such as depicted in FIG. 1.
Figure 8:
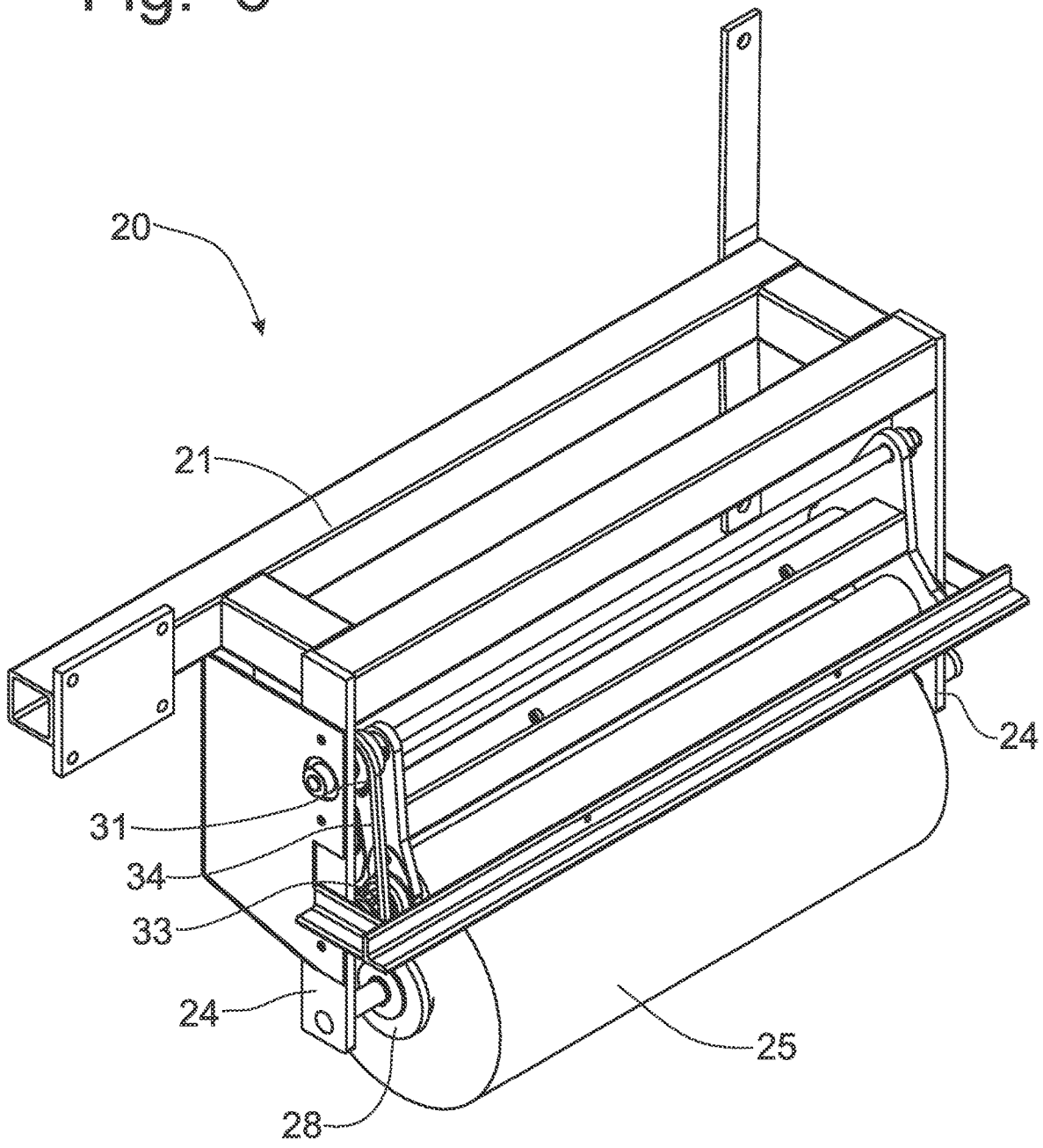
FIG. 8 is a right rear perspective view of the dispensing apparatus depicted in FIG. 7.
Figure 12:
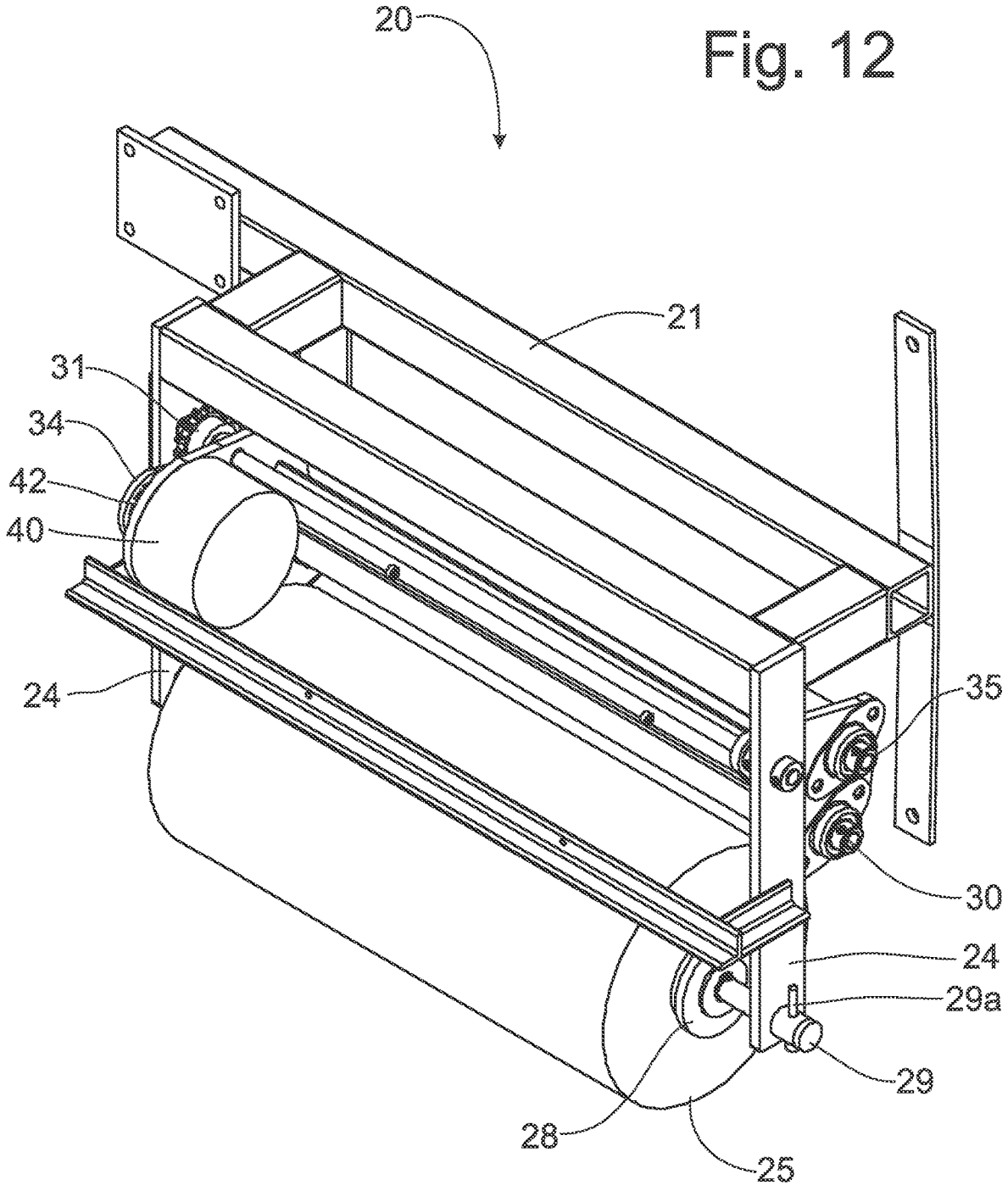
FIG. 12 is a left rear side perspective view similar to that of FIGS. 3 and 7, but depicting a third embodiment of the dispensing apparatus utilizing a chain drive interconnecting the feed rolls and a braking device for use on a wrapping mechanism such as depicted in FIG. 1.
Figure 13:
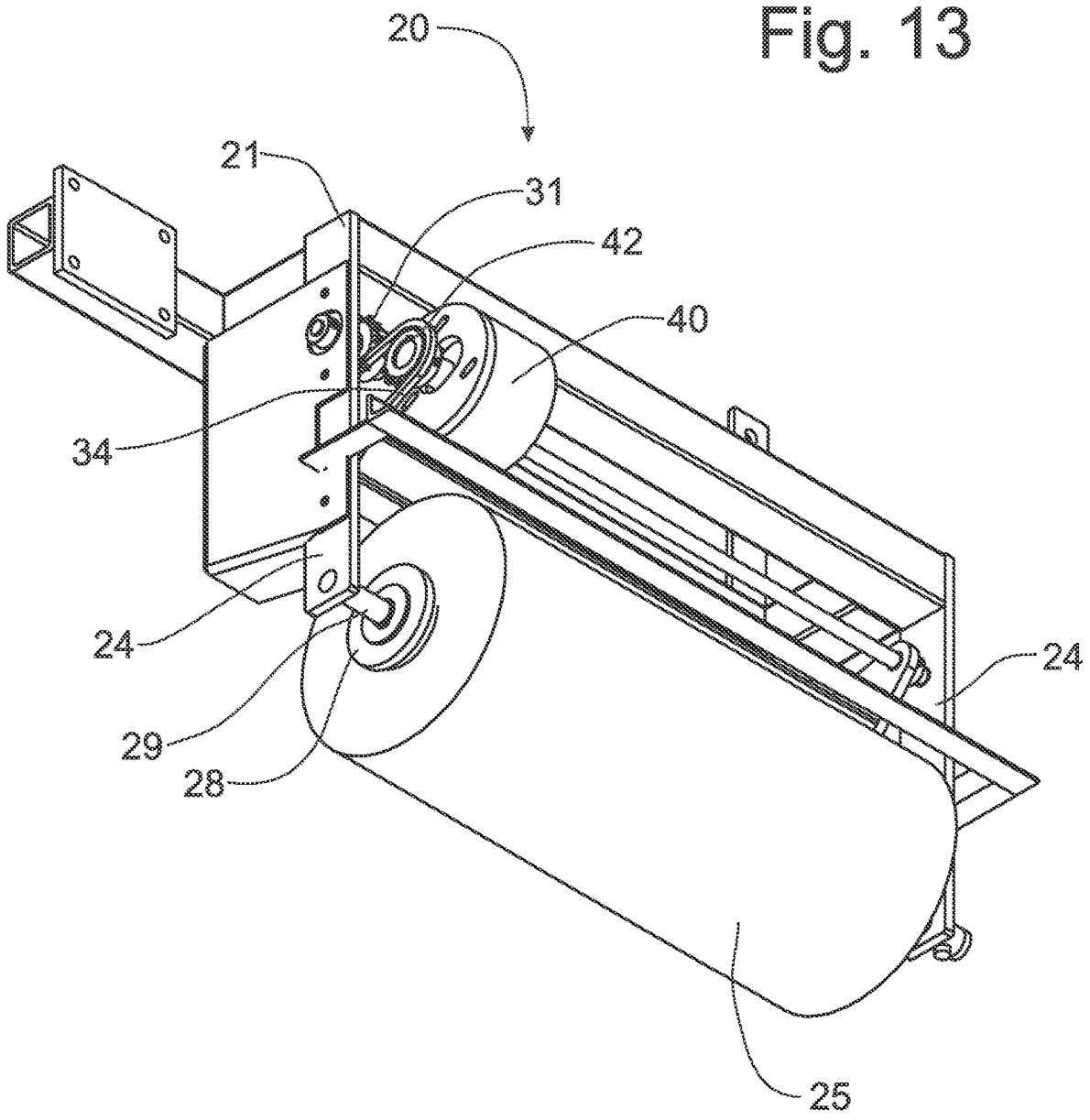
FIG. 13 is a lower right rear perspective view of the dispensing apparatus depicted in FIG. 12.

The stretch film dispenser 20 is best seen in FIGS. 2-4. The stretch film dispenser 20 20 includes a subframe 21 secured to the circular ring assembly 15 in an offset or cantilevered orientation. The subframe 21 can be stabilized by a pair of optional stabilizing rods 22 that are attached to the remote end of the subframe 21 and then to the circular ring assembly on opposite sides of the subframe 21 in a manner that will not interfere with the support of the exterior surface of the circular ring assembly 15 on the rotational supports 13, 13*a*. The subframe 21 rotatably supports the roll of stretch film 25, such as by a shaft 27 that extends through the core of the roll of stretch film 25 or through the application of end caps 28 as described in greater detail below. The subframe 21 also rotatably supports first and second feed rollers 30, 35 in proximity to the roll of stretch film 25 to receive the stretch film from the roll 25. Preferably, the feed rollers 30, 35 have the same diameter and are formed of a relatively soft rubber or neoprene.

Referring now to the first embodiment of the stretch film dispenser 20 shown in FIGS. 3-6, each of the two feed rollers 30, 35 have at one end thereof a gear 32, 37. The two gears 32, 37 are meshed with one another within a casing 39 to control the differential speed of the associated feed rollers 30, 35. The first feed roller 30, which is the feed roller that is physically closest to the roll of stretch film 25, has a larger gear 32 than the gear 37 at the end of the second feed roller 35, as is best seen in FIG. 5. The relative sizes of the two gears 32, 37 are such that the first feed roller 30 rotates approximately 45% slower than the second feed roller 35. The end result is that the stretch film wrapped from the supply roll 25 around the first feed roller 30 and then back wrapped around the second feed roller 35, as is reflected by the arrows in FIG. 17, has a tension induced thereon during the application of the stretch film to the cargo placed at the center of the rotatable circular ring assembly 15.

One skilled in the art will recognize that the two feed rollers 30, 35 are not powered in rotation. The rotation of the feed rollers 30, 35 is caused by the wrapping of the stretch film around the cargo as the circular ring assembly 15 rotates spinning the stretch film dispenser 20 20 around the cargo to apply the stretch film thereto. The pulling of the stretch film against the second feed roller 35 as the stretch film dispenser 20 20 is rotated with the circular ring assembly 15 around the cargo causes the second feed roller 35 to rotate. The intermeshed gears 32, 37, transfer the rotational movement of the second feed roller 35 to the first feed roller 30. The relative differential speeds of rotation of the first and second feed rollers 30, 35 induce tension into the stretch film as the stretch film is unrolled from the supply roll 25.

As best seen in FIG. 6, the roll 25 of stretch film is preferably mounted on a pair of end caps 28 positioned at each opposing end of the roll 25, although only one of the end caps 28 is depicted in FIG. 6. Each end cap 28 is mounted on a stub axle 29 that is supported in a mounting flange 24 forming part of the subframe 21. A pin 29*a* engaged in at least one of the stub axles 29 retains the stub axles 29 and associated end caps 28 in position on the subframe 21 to dispense a supply of stretch film from the roll 25 around the feed rollers 30, 35 to the cargo being wrapped. The end caps 28 are simply plugged into the opposing ends of the carrier tube (not shown) on which the stretch film is wrapped and retained there by friction and an inability to move laterally due to receipt of the stub axles 29 into the mounting flanges 24.

Figure 17:
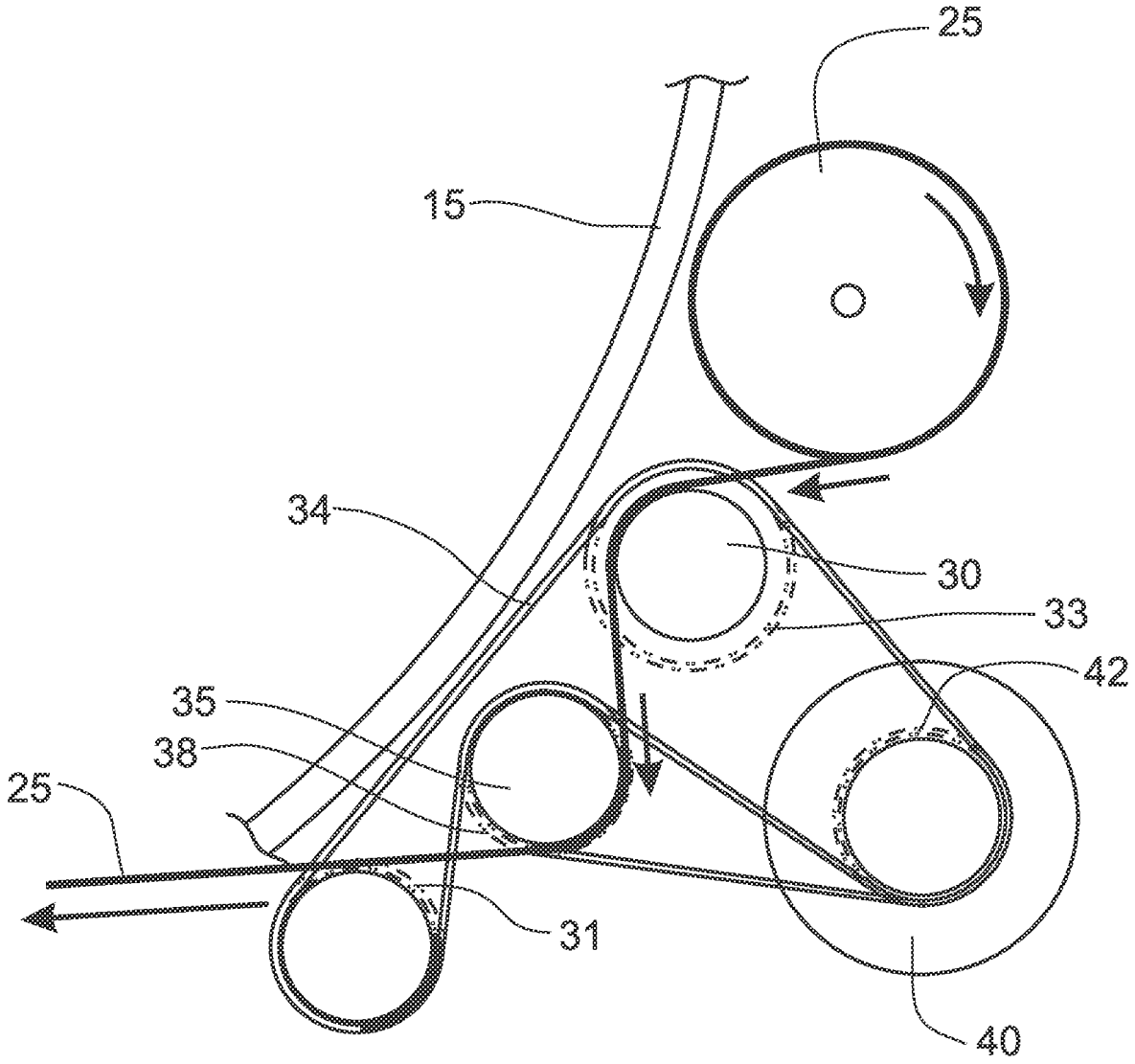
FIG. 17 is a schematic drive diagram of the stretch film dispensing apparatus shown in FIGS. 12-16.
Figure 18:
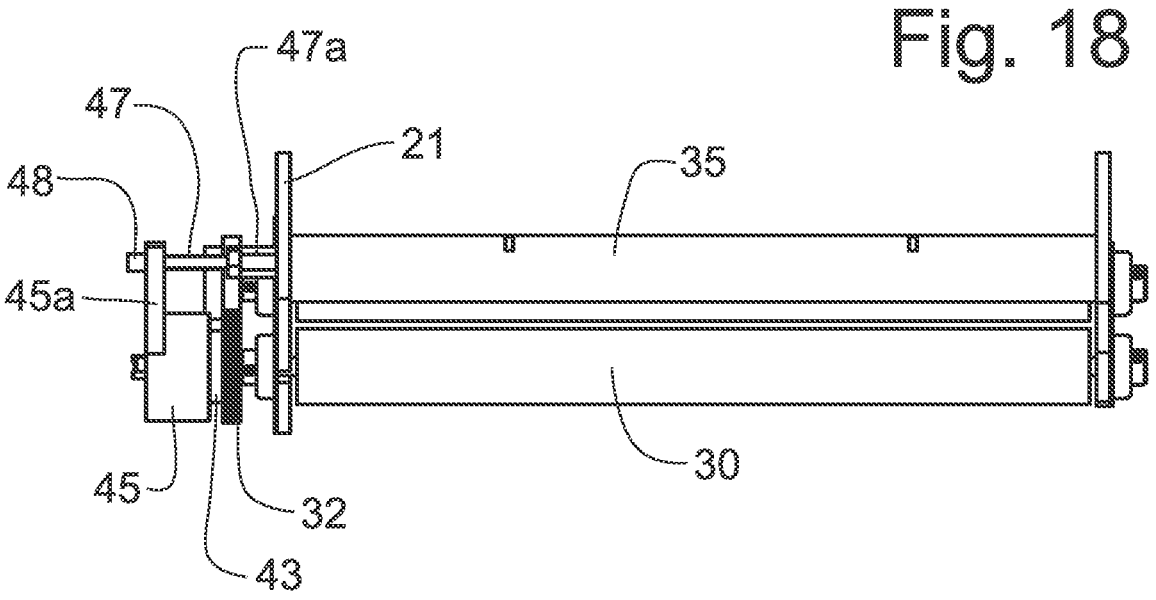
FIG. 18 is a rear elevational view of the feed roller assembly portion of the dispensing apparatus incorporating a manually adjustable braking device.

Referring now to FIGS. 7-11, a second embodiment of the stretch film dispenser 20 can be seen. The primary difference between the first embodiment of the stretch film dispenser 20 depicted in FIGS. 3-6 and the second embodiment of the stretch film dispenser 20 in FIGS. 7-11 is the manner in which the first feed roll 30 is driven from the second feed roll 35. In the second embodiment shown in FIGS. 7-11, the corresponding ends of the feed rolls 30, 35 have mounted thereon sprockets 33, 38, instead of intermeshed gears 32, 39. The sprockets 33, 38 are entrained by an endless chain 34 that transfers rotational motion from the second feed roll 35 to the first feed roll 30. The chain 34 requires a tensioning idler 31, which can be in the form of a positionable curved block 31*a* as depicted in FIG. 17, or as a separate idler sprocket 31*b* rotatably mounted on the subframe 21, to engage the chain 34 and maintain tension therein.

Referring now to the third embodiment of the stretch film dispenser 20 shown in FIGS. 12-16, a brake member 40 is added to the stretch film dispenser 20 20 to further restrict the movement of the stretch film from the roll 25 of stretch film around the two feed rolls 30, 35 and onto the cargo to be wrapped. The brake member 40 carries a sprocket 42 that is entrained by the chain 34 along with the sprockets 33, 38 on the two feed rolls 30, 35 and the tensioning idler 31 so that the movement of the chain 34 around the sprockets 33, 38, 31*b* and 42, is restricted by the brake member 40 which applies a drag on the chain 34. The use of the brake member 40 can allow the sprockets 33, 38 on the feed rolls 30, 35 to be the same size, as differential speed of the respective feed rollers 30, 35 is no longer needed as the brake member 40 will provide the necessary tension in the stretch wrap as the stretch film dispenser 20 20 is rotated about the circular ring assembly 15. Preferably, the brake member 40 will be operatively adjustable in a known manner to vary the resistance imparted by the brake member 40 in the application of the stretch film to the cargo.

Figure 19:
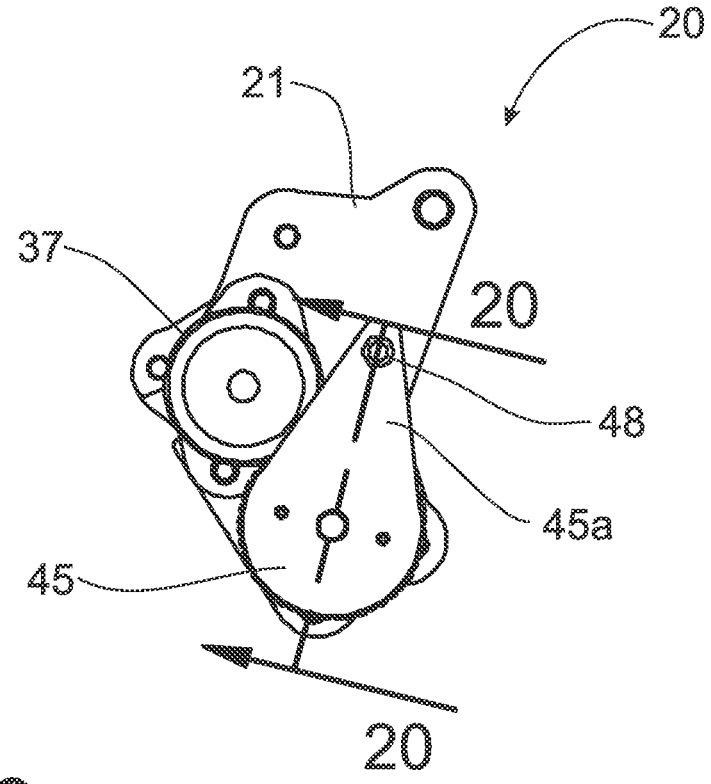
FIG. 19 is a right side elevational view of the feed roller assembly shown in FIG. 18.
Figure 20:
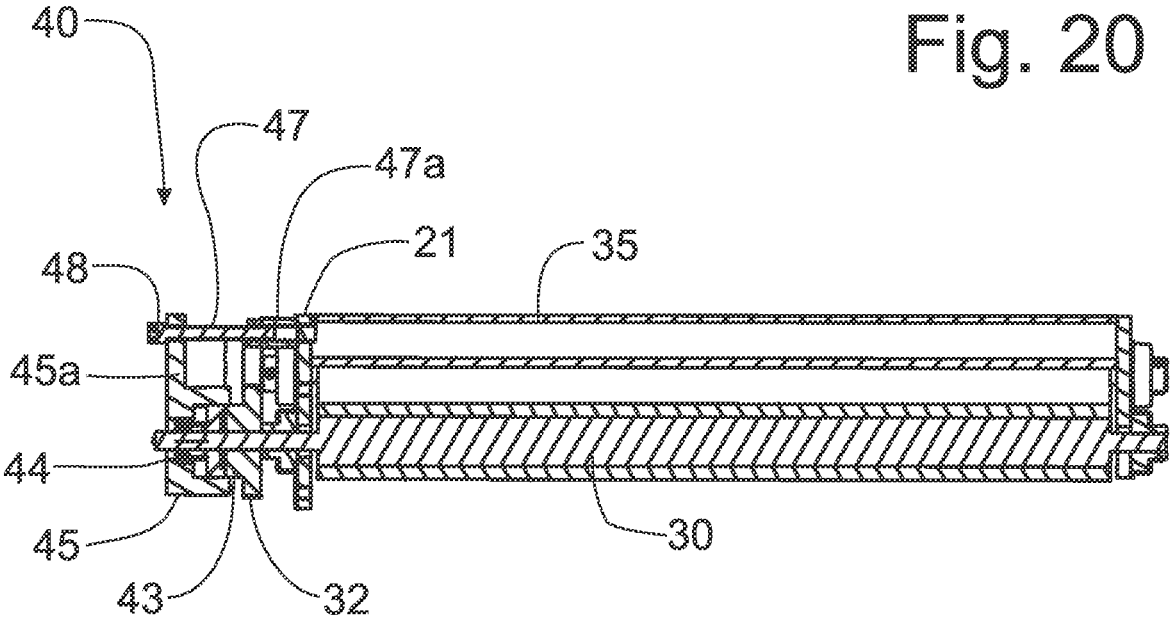
FIG. 20 is a cross-sectional view through the feed roller assembly taken along lines 20-20 of FIG. 19.
Figure 21:
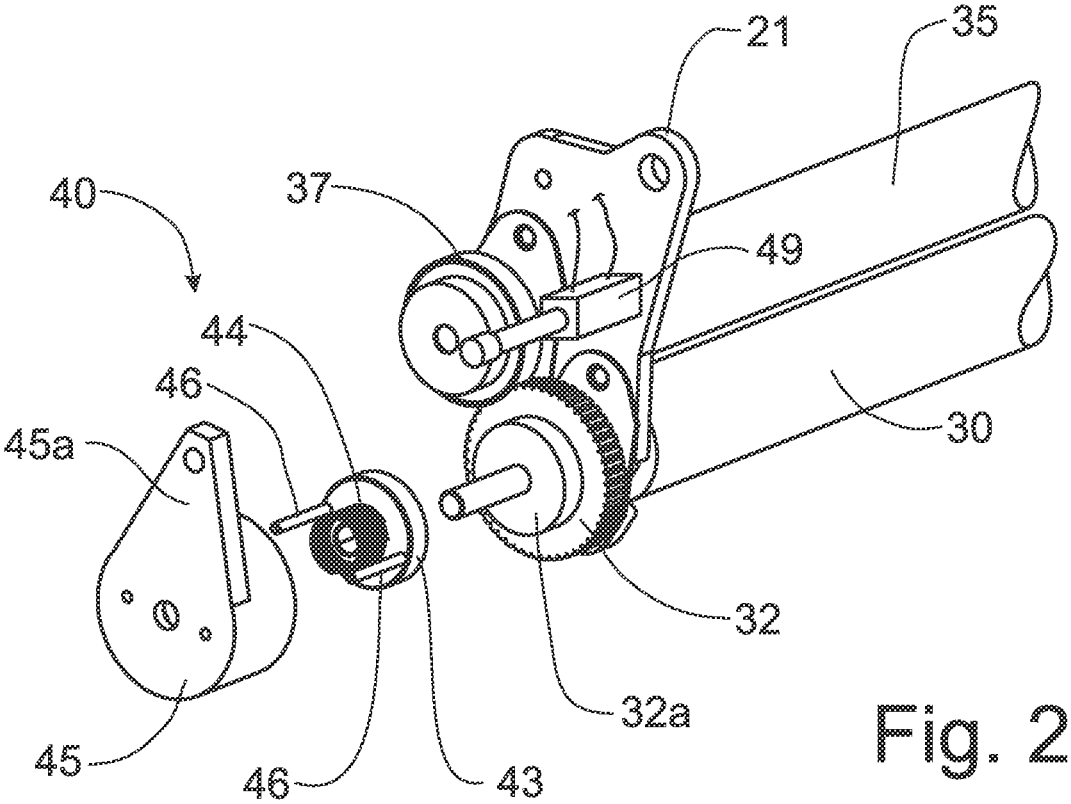
FIG. 21 is a partial perspective, exploded view of the feed roll assembly similar to that of FIG. 18, but depicting a remotely controlled actuator for adjusting the tension applied by the braking device.

A manually adjustable brake member 40 is depicted in FIGS. 19-21. The gear 32 is modified to include a rotor portion 32*a* against which a braking disc 43 presses into engagement to restrict the rotation of the gear 32. The braking disc 43 is biased against the rotor portion 32*a* by s compression spring 44 that is contained by a spring housing 45 received on a pair of guide pins 46 supported on the braking disc 43. The spring housing 45 is movable along the guide pins 46 to selectively vary the compression on the spring 44, and thus the spring force exerted by the spring 44 onto the braking disc 43. The position of the spring housing 45 is controlled by the adjustment rod 47 that has a head portion 48 capturing an actuation arm 45*a* on the spring housing 45. The adjustment rod 47 is treaded into a mount 47*a* supported on the subframe 21 to allow the adjustment rod 47 to move relative to the mount 47*a*.

In operation, the amount of tension placed on the stretch film as the stretch film is being wrapped around the cargo is a function of the amount of spring force exerted by the spring 44 onto the braking disc 43 to engages the face of the rotor portion 32*a*. The compression of the spring 44 is controlled by moving the adjustment rod 47 into or outwardly of the mount 47*a*, as this movement controls the positioning of the spring housing 45 along the guide pins 46. A selective movement of the adjustment rod 47 can be accomplished by utilizing an Allen wrench (not shown) or socket wrench (not shown) to engage the head portion 48 and cause rotation thereof.

In FIG. 21, a variation of the manually adjustable braking device 40 can be seen. In lieu of an adjustment rod 47 threaded into a mount 47, the position of the spring housing 45 along the guide pins 46 can be controlled by a linear actuator 49 secured to the subframe 41 and connected to the actuation arm 45*a* for extension and retraction that moves the spring housing 45 along the guide pins 46. The linear actuator 49 is preferably electrically operated, and may be battery powered, to permit a remote control of the movement of the linear actuator 49, and the amount of tension asserted on the stretch film as the stretch film is applied to the cargo being wrapped. A remote controller (not shown) can vary the tension in the stretch wrap as the stretch wrap is being applied by increasing the spring force exerted by the spring 44 as a function of the number of revolutions of the stretch film dispenser 20 around the cargo being wrapped. As a result, the initial wraps of the stretch film can be applied to the cargo under low torque and then increase with each revolution or each increment of revolutions of the stretch film dispenser 20 20 around the cargo.

In operation, the pallet (not shown) having a cargo (not shown) supported thereon is lifted by a fork lift (not shown) with the tines inserted into the pallet in a conventional manner. The fork lift operator inserts the cargo bearing pallet into the center of the circular ring assembly 15. The loose end of the stretch film is secured on the cargo and the electric motor 17 is started to drive the rotation of the rotational support 13*a*, which is considered the drive wheel. The drive wheel 13*a* rotates the circular ring assembly 15 and rotates the stretch film dispenser 20 around the pallet and the cargo mounted thereon. As the stretch film dispenser 20 is rotated around the pallet and cargo, the fork lift operator advances the fork lift, and the pallet supported thereon further into the circular ring assembly 15, thus advancing the cargo and pallet longitudinally relative to the longitudinally fixed circular ring assembly 15 and the base frame 11.

The differentially rotated feed rollers 30, 35 of the stretch film dispenser 20 keep the stretch film taut as the stretch film is wrapped around the cargo and pallet. As a result, the cargo and pallet require less stretch film to stabilize the cargo on the pallet and the wrapping of the cargo and pallet. Accordingly, the process of wrapping a cargo and pallet for shipment will take less time to accomplish. Furthermore, since the base frame 11 of the orbital wrapping apparatus 10 does not have a track to enable the longitudinal movement of the circular ring assembly relative to the cargo, the orbital wrapping apparatus can be manufactured less expensively. When the cargo and pallet have been wrapped adequately with the stretch film to stabilize the cargo on the pallet, the stretch film is severed and the fork lift operator withdraws the wrapped pallet and cargo for subsequent shipping. One skilled in the art will note that the stretch film is wrapped in an orbital manner around both the pallet and the cargo, thus securing the cargo to the pallet and providing a highly stabilized package for shipment. In the third embodiment of the stretch film dispenser 20, as described above, the brake member 40 will maintain tension in the stretch film as the stretch film is being wrapped around the cargo to be shipped.

Figure 22:
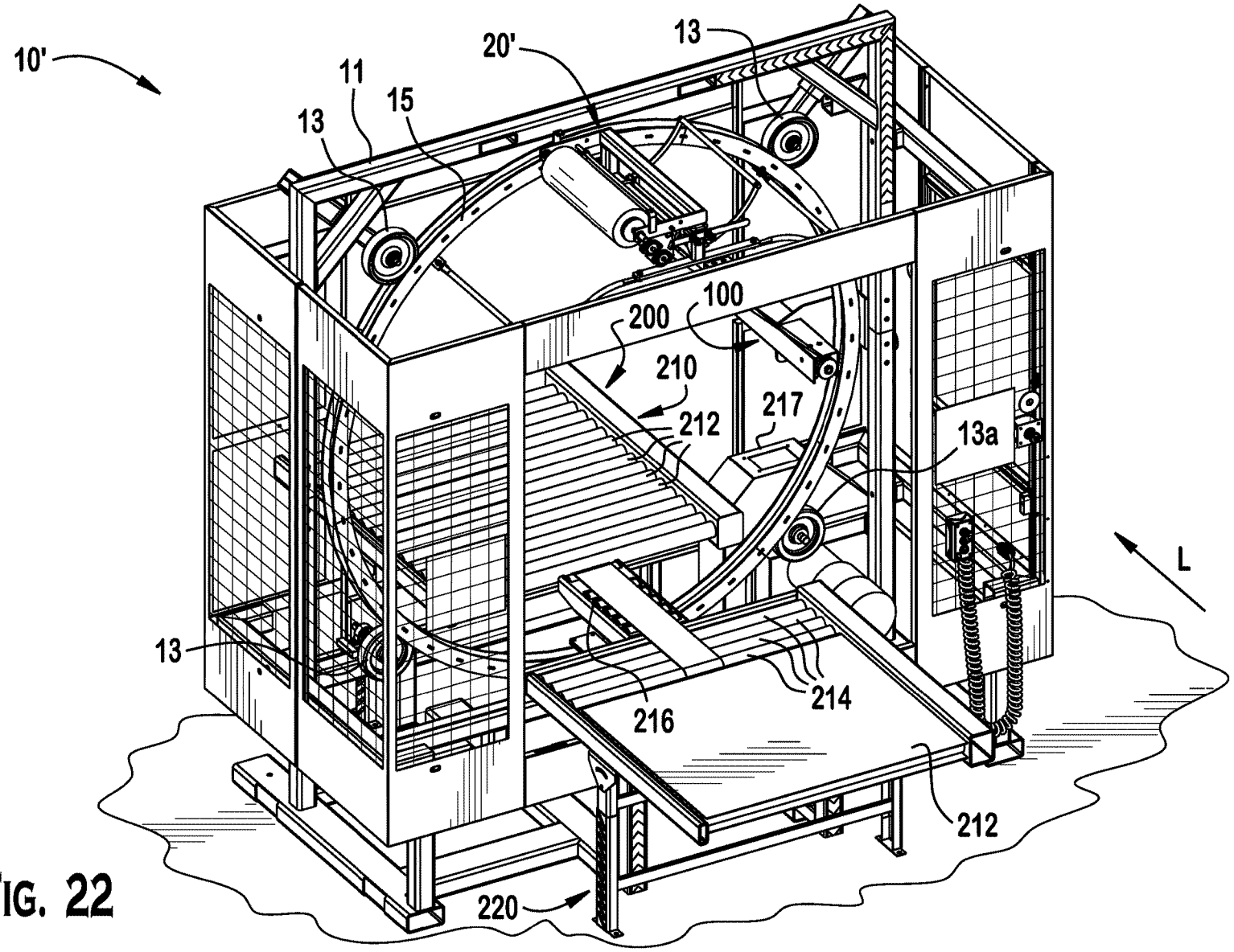
FIG. 22 is a perspective view of an orbital wrapping apparatus according to an embodiment.

Now with reference to FIG. 22, another orbital wrapping apparatus 10' according to the invention is shown. For sake of brevity, reference numbers refer to like elements and only the differences from the orbital wrapping apparatus 10 shown in FIG. 1 will be described in detail herein.

Generally, the orbital wrapping apparatus 10' according to another embodiment of the invention generally includes a cutting assembly 100 and a stretch film dispenser 20'.

Figure 23:
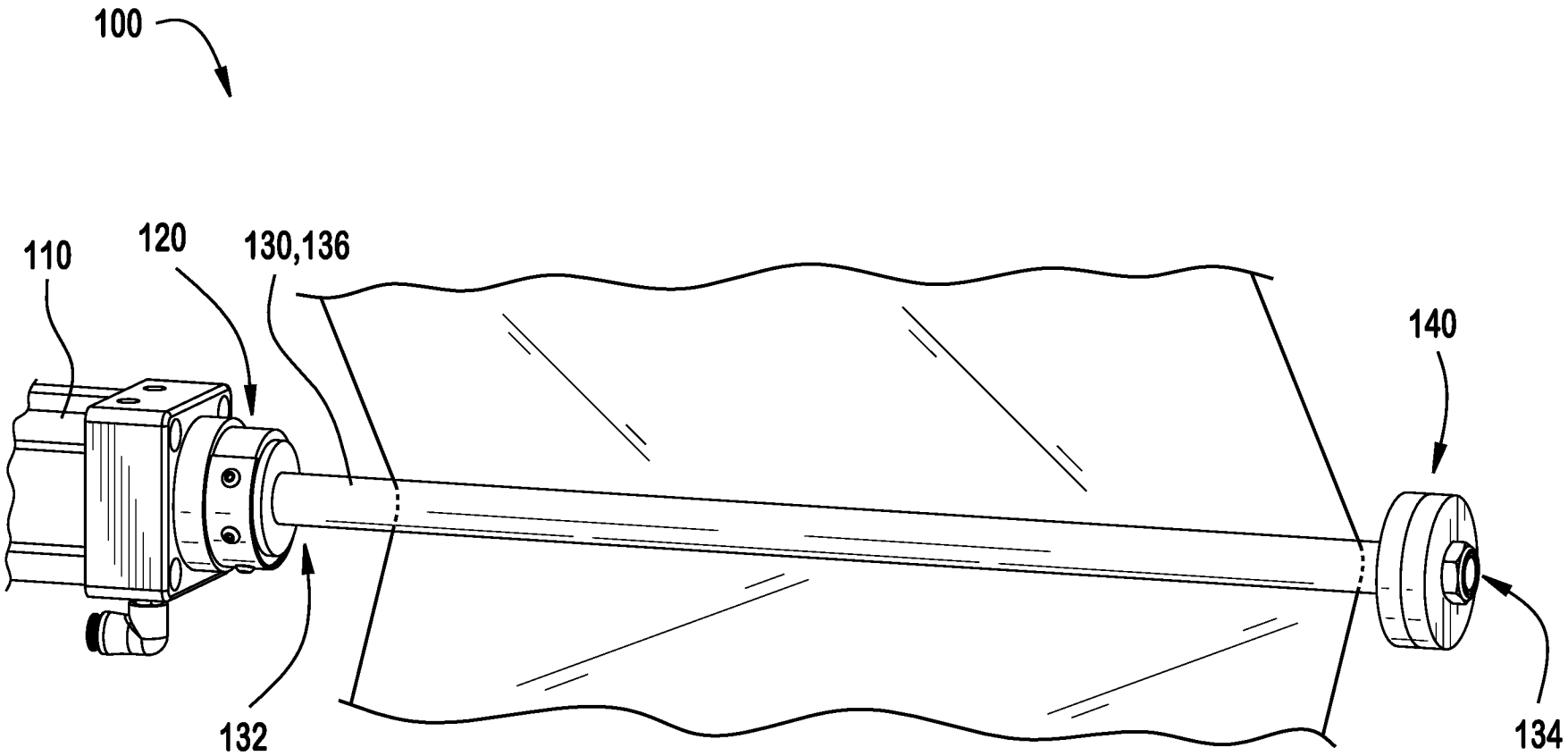
FIG. 23 is a perspective view of a cutting assembly of the orbital wrapping apparatus in an extended position.
Figure 24:
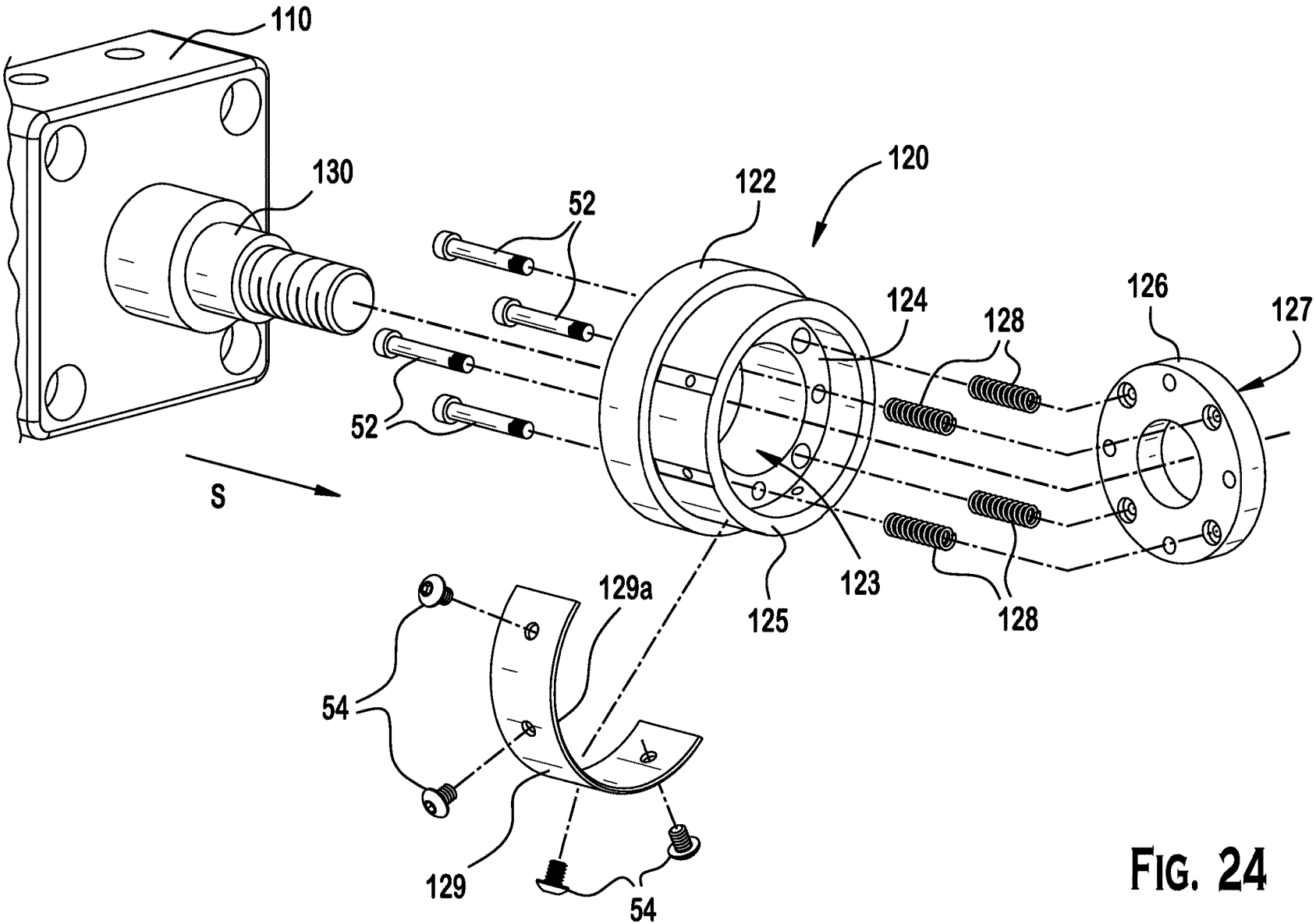
FIG. 24 is an exploded view of a cutter head of the cutting assembly.
Figure 25:
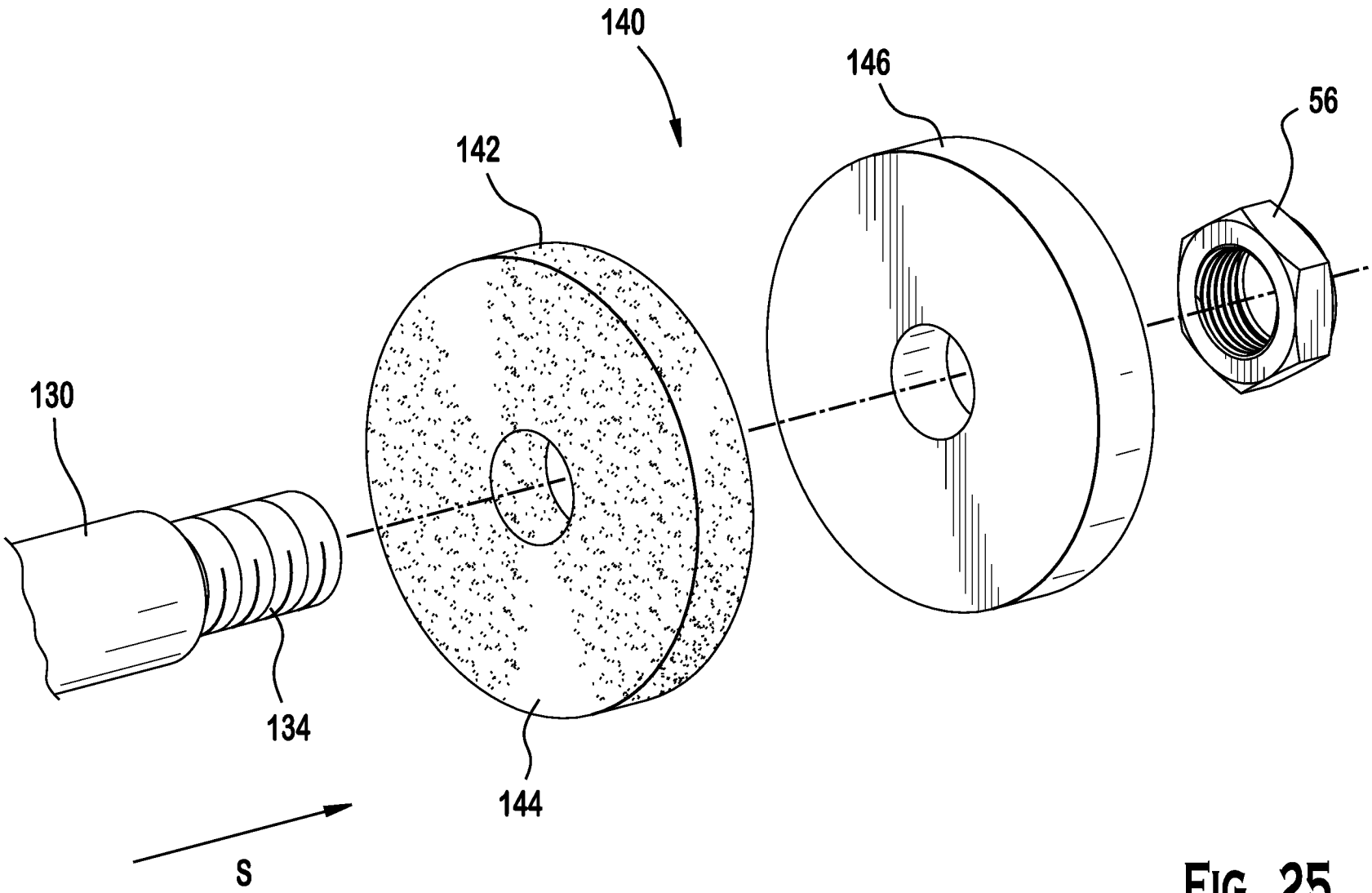
FIG. 25 is an exploded view of a pinch head of the cutting assembly.

First, with reference to FIGS. 23-25, an exemplary embodiment of the cutting assembly 100 is shown and generally includes a cutting motor 110, a cutter head 120 attached to the cutting motor 110, a shaft 130 movable by the cutting motor 110, and a pinch head 140 attached to an end of the shaft 130.

The cutting assembly 100 is generally mounted to the base frame 11 and extends through an opening defined by the circular ring assembly 15 as shown in FIG. 22; the circular ring assembly 15 is free to rotate around the cutting assembly 100. The cutting motor 110 may be an electric motor, a hydraulic motor, or any other type of motor known to those with ordinary skill in the art. In an exemplary embodiment of the invention in which the cutting motor 110 is a hydraulic motor, the cutting motor 110 includes an air silencer.

The cutter head 120 is shown in FIG. 24 and includes a cutter housing 122, a spring pad 126, and a blade 129.

The cutter housing 122, as shown in FIG. 24, has an approximately cylindrical shape defining a spring pad receiving passageway 123 extending through the cutter housing 122. The cutter housing 122 has a stop 124 at which the spring pad receiving passageway 123 narrows. A first end of the cutter housing 122 is attached to the cutting motor 110 and an opposite second end of the cutter housing 122 is a cut surface 125.

The spring pad 126, as shown in FIGS. 23 and 24, is a disc-shaped member disposed in the spring pad receiving passageway 123 and includes a pinch surface 127 on a side disposed further from the cutting motor 110 in a longitudinal direction S of the shaft 130. The spring pad 126 is retained within the spring pad receiving passageway 123, with a plurality of springs 128 disposed between the spring pad 126 and the cutter housing 122, by a plurality of first fasteners 52 extending through the cutter housing 122. The first fasteners 52 are bolts in the shown embodiment. However, one skilled in the art should appreciate the first fasteners 52 could be other known fastener, including screws or any other type of fastener that could retain the spring pad 126 within the cutter housing 122 while permitting movement of the spring pad 126 with respect to the cutter housing 122. In an exemplary embodiment, both the cutter housing 122 and the spring pad 126 are formed of a metal material.

The first fasteners 52 permit movement of the spring pad 126 with respect to the cutter housing 122 between a depressed position and a protruding position. In the depressed position, described in greater detail below, the spring pad 126 is positioned adjacent the stop 124 and the pinch surface 127 of the spring pad 126 is approximately flush with the cut surface 125 of the cutter housing 122. In the protruding position, shown in FIG. 23, the pinch surface 127 of the spring pad 126 protrudes beyond the cut surface 125 of the cutter housing 122. The plurality of springs 128 provide a spring force biasing the spring pad 126 into the protruding position.

The blade 129, as shown in FIG. 24, is a semi-circular member having a sharp edge 129*a* disposed along one side. The blade 129 is attached to an outer surface of the cutter housing 122 by a plurality of second fasteners 54 such that the sharp edge 129*a* faces away from the cutting motor 110 and protrudes beyond the cut surface 125 in the longitudinal direction S. The second fasteners 54 are screws in the shown embodiment. In other embodiments, the second fasteners 54 may be bolts or any other type of fastener capable of retaining the blade 129 on the outer surface of the cutter housing 122. In an exemplary embodiment of the invention, the sharp edge 129*a* is beveled on both sides.

The shaft 130, as shown in FIG. 23, is an elongated cylindrical member having a first end 132 and an opposite second end 134. The shaft 130 is movable the cutting motor 110 between a retracted position shown in FIG. 22 and an extended position shown in FIG. 23. The first end 132 is disposed within the cutting motor 110 in the retracted position. In an exemplary embodiment of the invention, the shaft 130 has a coating 136 disposed on an outer surface of the shaft 130. The coating 136 is a non-stick coating such as Polytetrafluoroethylene (PTFE) known under the brand name Teflon. In other embodiments, the coating 136 may be any type of non-stick coating known to those with ordinary skill in the art.

The pinch head 140 is attached to the second end 134 of the shaft 130 and, as shown in FIG. 25, includes a pinching plate 142 and a support plate 146. Both the pinching plate 142 and the support plate 146 are disc-shaped members having a central receiving passageway receiving the threaded second end 134 of the shaft 130. A third fastener 56 attaches the pinch head 140 to the second end 134 of the shaft 130. In the shown embodiment, the third fastener 56 is a nut engaging the threaded second end 134 of the shaft 130. In other embodiments, the third fastener 56 may be any other type of fastener capable of retaining the pinch head 140 on the second end 134 of the shaft 130.

The pinching plate 142, as shown in FIGS. 23 and 25, is positioned closer to the cutter head 120 than the support plate 146 in the longitudinal direction S. The pinching plate 142 has a pinch surface 144 facing the cutter head 120 and the support plate 146 abuts a surface of the pinching plate 142 opposite the pinch surface 144. In an exemplary embodiment of the invention, the pinching plate 142 is formed of a polymer, such as nylon. In one embodiment, the pinching plate 142 is a nylon material that is water jet cut and machined to form a flat pinch surface 144. One skilled in the art should appreciate that other materials could be used that limit the amount of wear to the blade 129. In an exemplary embodiment of the invention, the support plate 146 is formed of a metal material.

Figure 26:
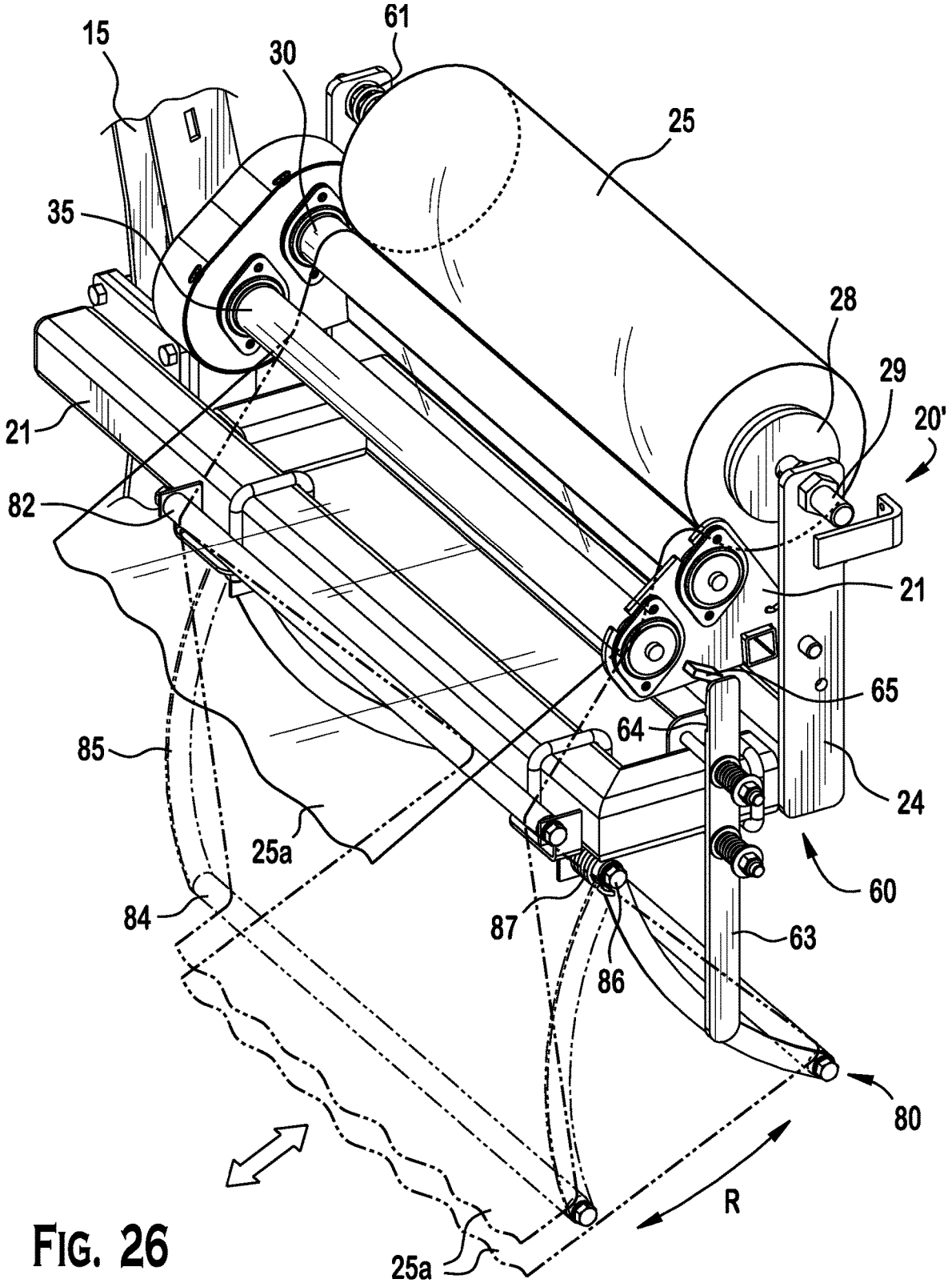
FIG. 26 is a perspective view of a stretch film dispenser according to an embodiment.
Figure 27:
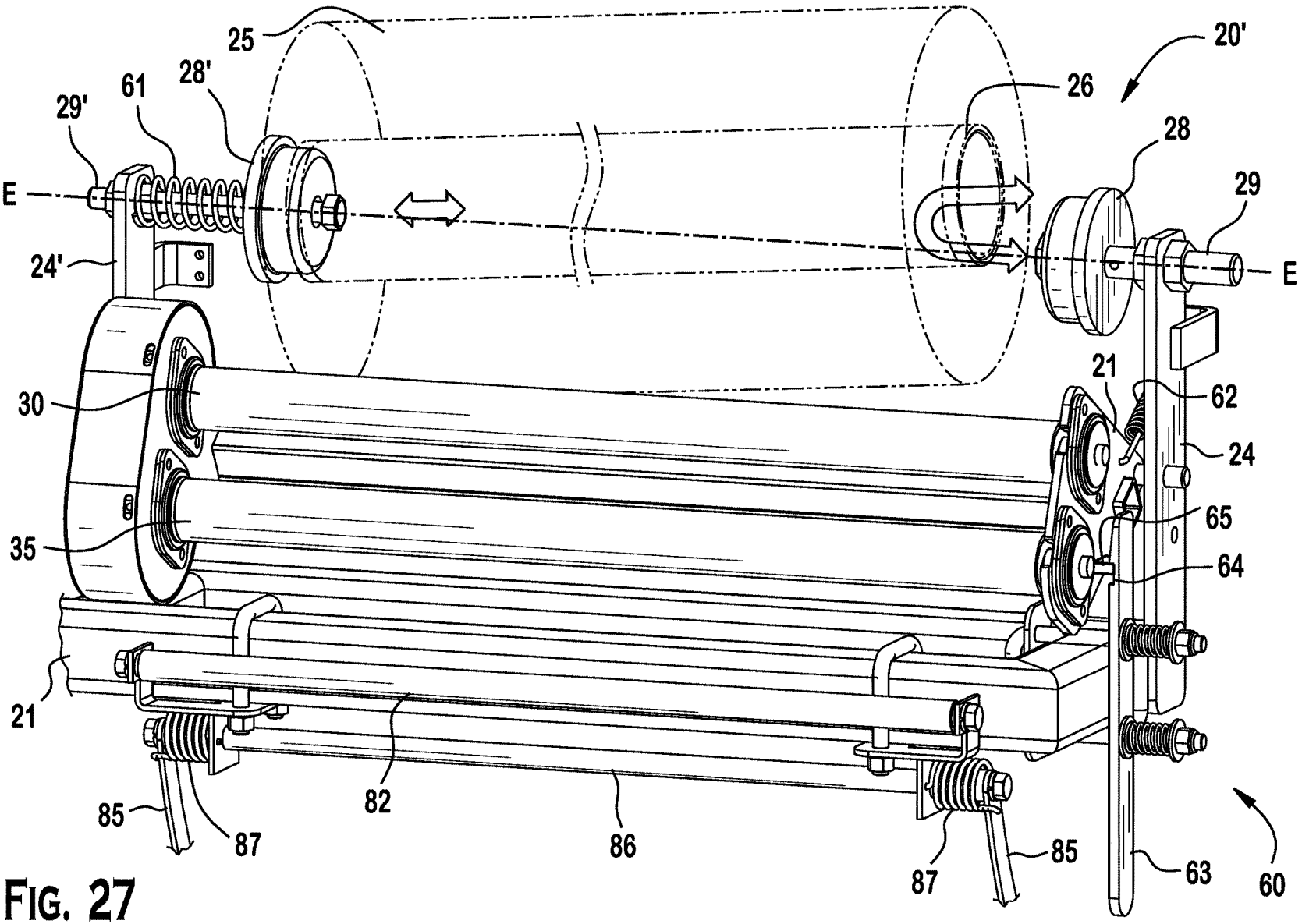
FIG. 27 is a perspective view of a loading assembly of the stretch film dispenser.

The stretch film dispenser 20' of the orbital wrapping apparatus 10' is shown in FIGS. 26 and 27. In addition to the elements described above with respect to the stretch film dispenser 20, the stretch film dispenser 20' in the embodiment of FIGS. 26 and 27 includes a loading assembly 60 and a tension assembly 80.

The loading assembly 60, as shown in FIGS. 26 and 27, includes an end cap spring 61 surrounding one of the stub axles 29'. The stub axle 29' is movable longitudinally with respect to the mounting flange 24' while the stub axle 29 is fixed to the mounting flange 24. The end cap spring 61 abuts the end cap 28' and the mounting flange 24' and provides a spring force biasing the end cap 28' toward the other end cap 28. The loading assembly 60 further includes a subframe spring 62 connecting the portion of the subframe 21 supporting the first and second feed roller 30, 35 to the mounting flange 24, a lever 63 pivotably supported on the subframe 21, and a protrusion 65 extending from a surface of the portion of the subframe 21 supporting the first and second feed rollers 30, 35. The lever 63 has a recess 64 at an end of the lever 63 and is pivotable between a position in which the recess 64 is capable of receiving the protrusion 65 and a position in which the recess 64 is spaced apart from the protrusion 65.

The tension assembly 80, as shown in FIG. 26, includes a third feed roller 82 and a fourth feed roller 84. In an exemplary embodiment of the invention, the third feed roller 82 and the fourth feed roller 84 are formed of a same material as the first and second feed rollers 30, 35 but each have a narrower diameter than the first and second feed rollers 30, 35. The third feed roller 82 is mounted to the subframe 21 and is rotatable with respect to the subframe 21. The fourth feed roller 84 is attached to a first end of a tension frame 85 and is rotatable with respect to the tension frame 85. A pivot axle 86 is fixed to a second end of the tension frame 85. The pivot axle 86 is mounted to the subframe 21 and is rotatable with respect to the subframe 21 such that the tension frame 85 can also rotate with respect to the subframe 21 in a rotation direction R shown in FIG. 26. A plurality of pivot springs 87 are mounted on the pivot axle 86 and bias the tension frame 85 and fourth feed roller 84 toward the roll 25 of stretch film in the rotation direction R.

The use of the orbital wrapping apparatus 10' to wrap a cargo in stretch film will now be described primarily with reference to FIGS. 27-37.

The roll 25 of stretch film is first mounted on the pair of end caps 28, 28' as shown in FIG. 27. A user grasps the portion of the subframe 21 supporting the first and second feed rollers 30, 35 and moves this portion of the subframe 21 from a first position adjacent to an axis E in which the stub axles 29, 29' extend to a second position spaced further apart from the axis E. The subframe spring 62 provides a spring force biasing this portion of the subframe 21 toward the first position. The lever 63 is pivoted to engage the protrusion 65 as shown in FIG. 27, holding the portion of the subframe 21 in the second position spaced further from the axis E.

With the portion of the subframe 21 in the second position, the user places a first end of a carrier tube 26 of the roll 25 of stretch film on the end cap 28' as shown in FIG. 27. The user provides a force counter to the spring force of the end cap spring 61, compressing the end cap spring 61 and moving the end cap 28' toward the mounting flange 24' until an opposite second end of the carrier tube 26 can be moved into alignment with the axis E without contacting the end cap 28. The carrier tube 26 and roll 25 are then pivoted down and the second end of the carrier tube 26 is positioned to engage the end cap 28. When the user releases the roll 25, the end cap spring 61 provides a force holding the roll 25 between the end caps 28, 28'. The lever 63 is pivoted to release the protrusion 65 when the roll 25 is held between the end caps 28, 28' and the subframe spring 62 moves the portion of the subframe 21 back to the first position.

An initial preparation of the orbital wrapping apparatus 10' for wrapping the cargo is shown in FIGS. 28-32.

Figure 28:
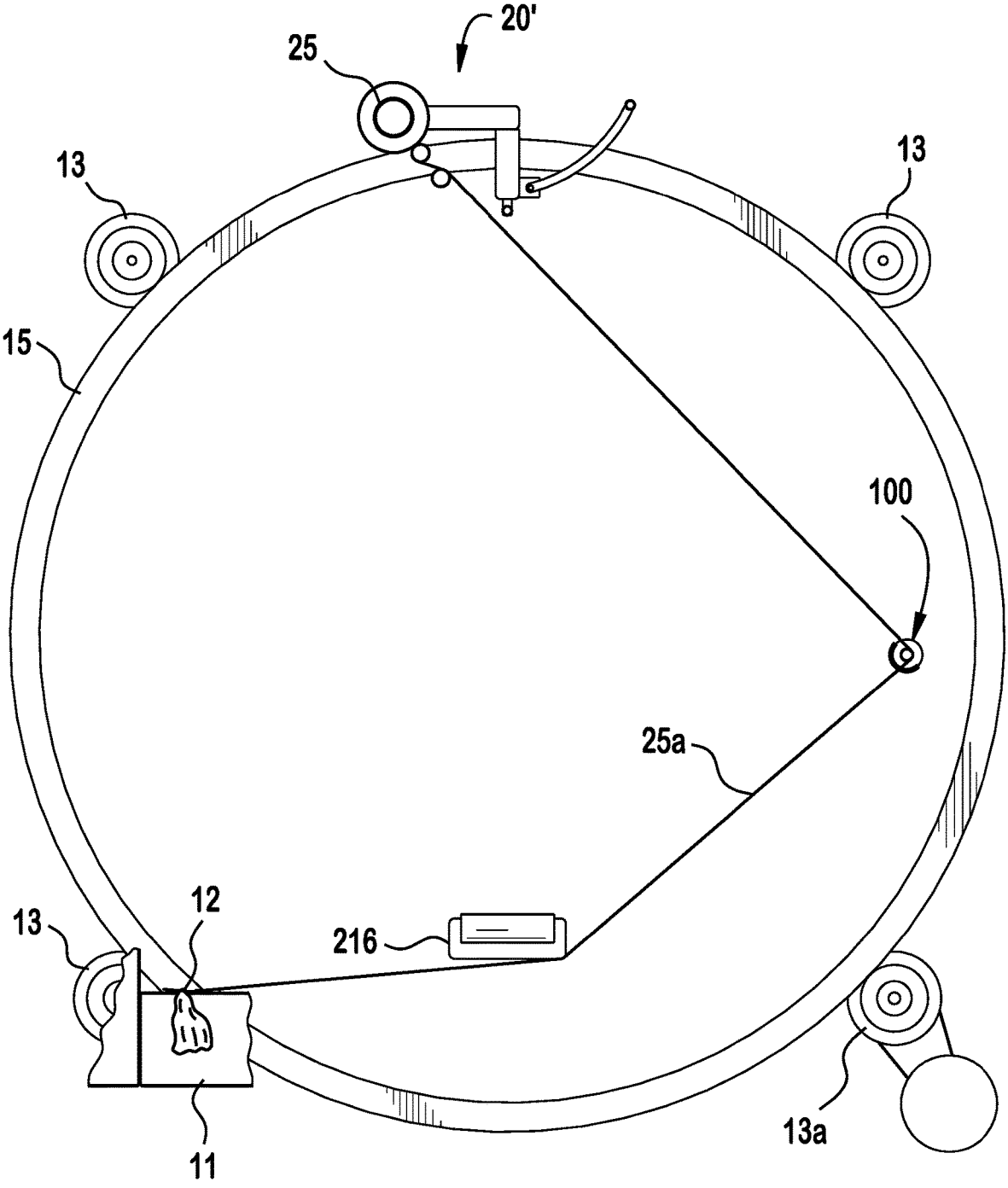
FIG. 28 is a front view of an initial preparation of the orbital wrapping apparatus of FIG. 22.

Stretch film 25*a* from the roll 25 of stretch film is attached to a tie down 12 disposed on the base frame 11, as shown in FIG. 28, and the stretch film 25*a* extends around the shaft 130 of the cutting assembly 100 as shown FIG. 23 with the shaft 130 in the extended position. The cutting motor 110 is actuated and moves the shaft 130 into the retracted position shown in FIG. 29-31.

Figure 29:
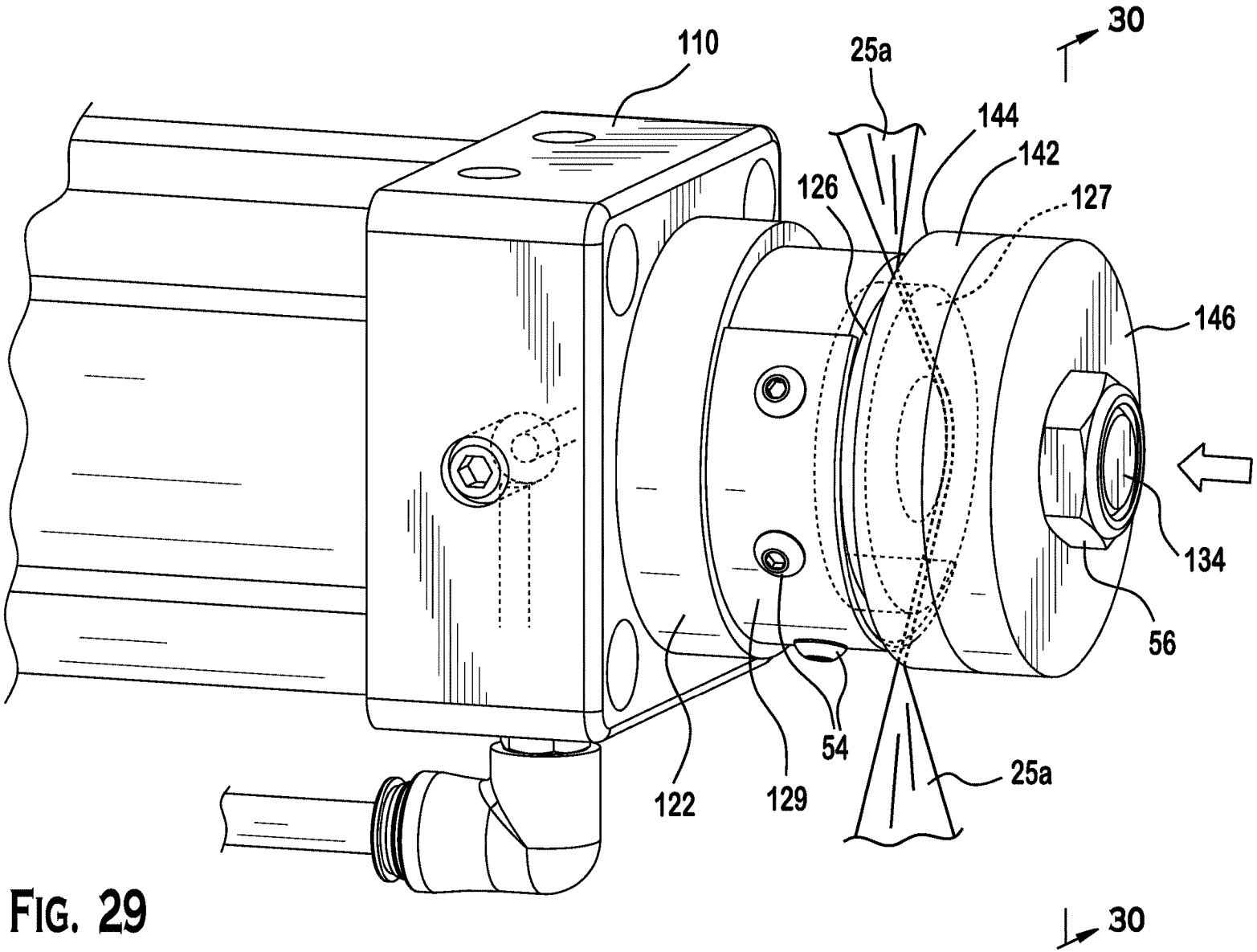
FIG. 29 is a perspective view of the cutting assembly of FIG. 23 in a retracted position.
Figure 30:
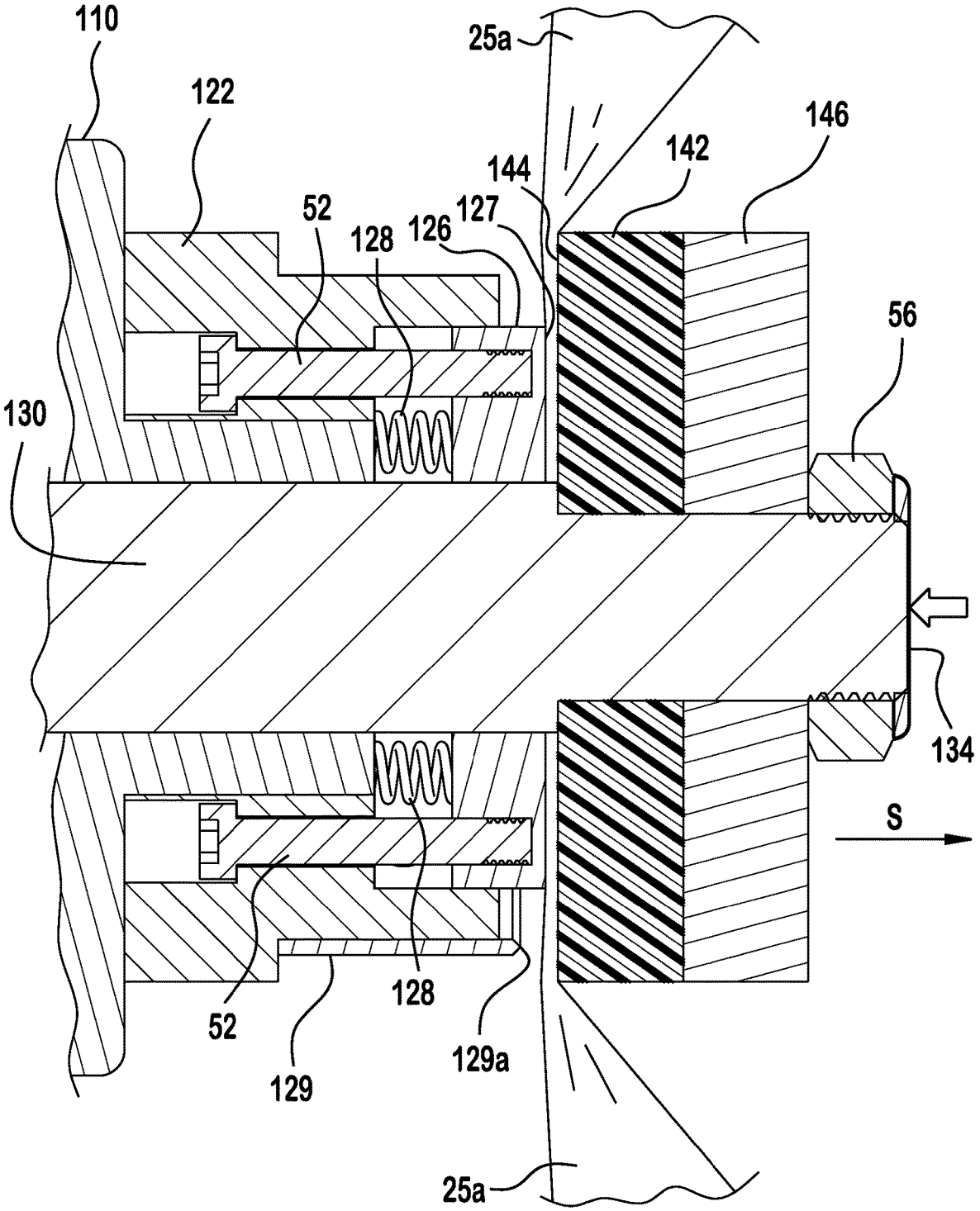
FIG. 30 is a sectional view of the cutting assembly in the retracted position.

During motion of the shaft 130 from the extended position into the retracted position, the stretch film 25*a* slides with respect to the shaft 130 and is gathered and compressed between the pinch surface 144 of the pinching plate 142 and the pinch surface 127 of the spring pad 126 as shown in FIGS. 29 and 30. The spring pad 126 is initially in the protruding position due to the biasing force of the springs 128, as shown in FIGS. 29 and 30, such that the stretch film 25*a* is spaced apart from the sharp edge 129*a* of the blade 129.

Figure 31:
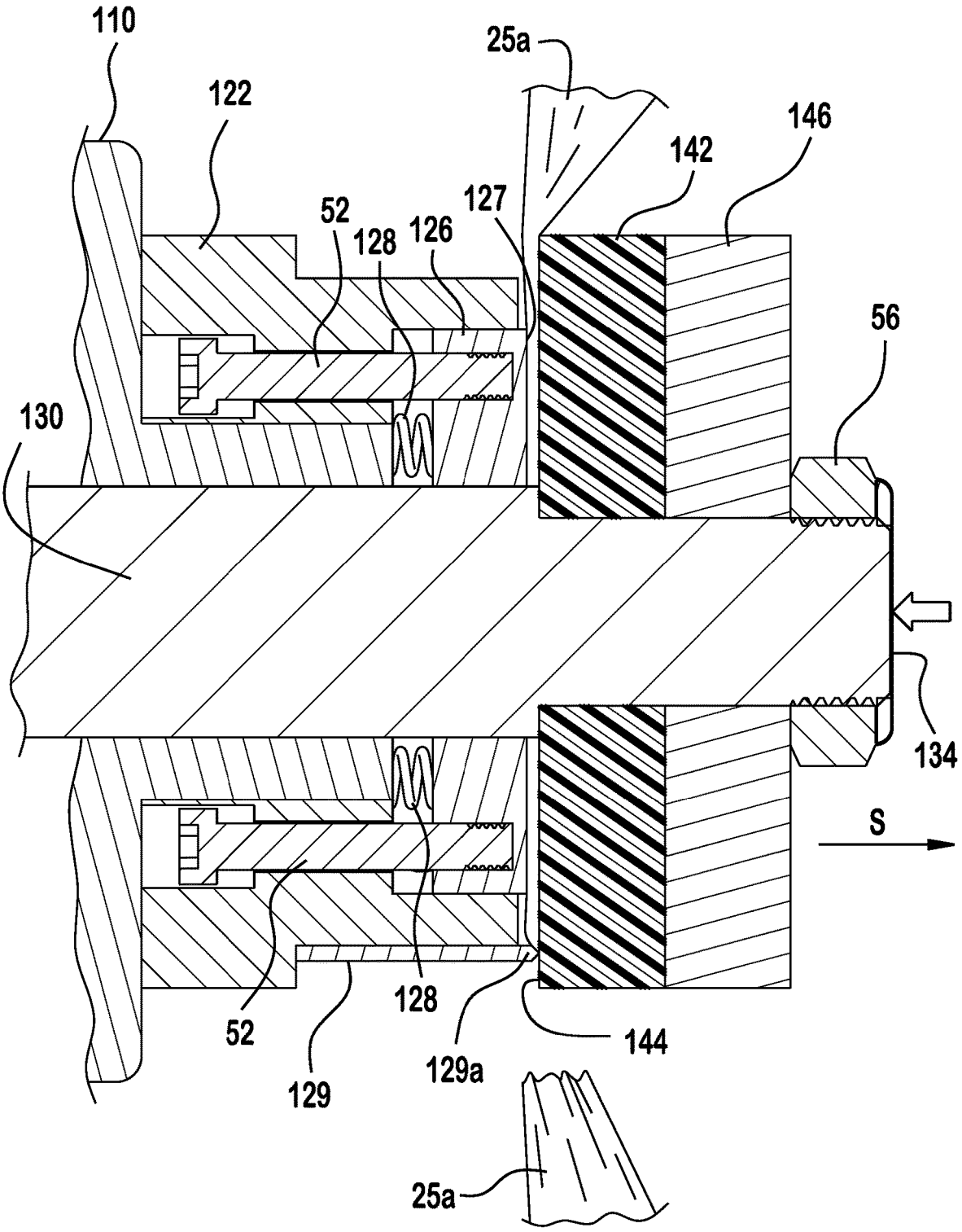
FIG. 31 is another sectional view of the cutting assembly in the retracted position.

As the force imparted by the cutting motor 110 moving the shaft 130 into the retracted position overcomes the spring force of the springs 128, the spring pad 126 is moved into the depressed position shown in FIG. 31 while the stretch film 25*a* remains gathered and compressed between the pinch surfaces 127, 144. The sharp edge 129*a* begins to protrude beyond the pinch surface 127 of the spring pad 126 as the spring pad 126 moves into the depressed position. As shown in FIG. 31, the sharp edge 129*a* then penetrates the compressed stretch film 25*a* until it contacts the pinch surface 144 of the pinching plate 142, severing the stretch film 25*a*.

Figure 32:
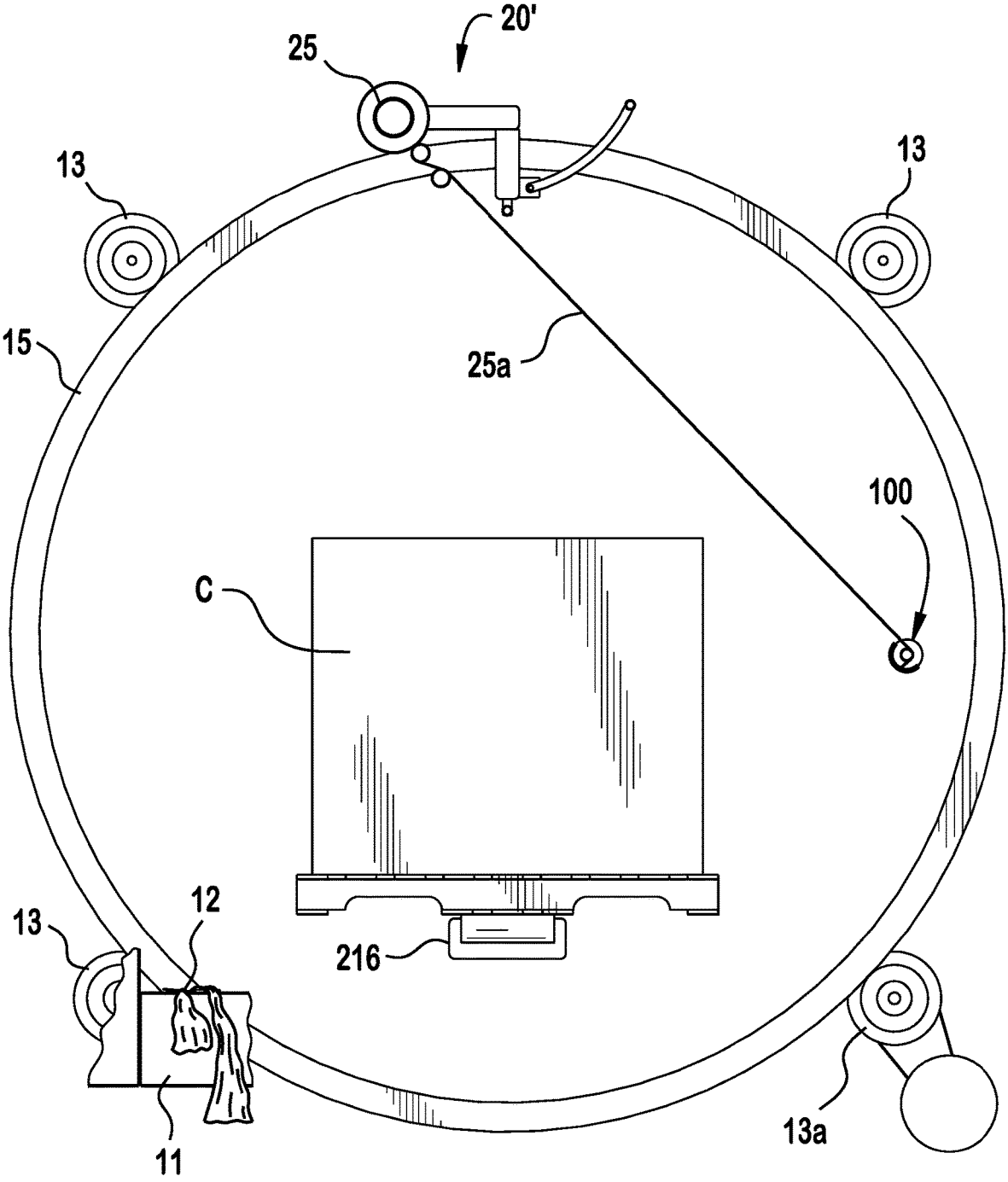
FIG. 32 is a front view of a cargo inserted into the orbital wrapping apparatus of FIG. 22.

A portion of the stretch film 25*a* attached to the tie down 12 is separated from a portion of the stretch film 25*a* connected to the roll 25 by the blade 129. The cutting motor 110 holds the shaft 130 in the retracted position and the portion of the stretch film 25*a* attached to the roll 25 remains held by compression between the pinch surface 144 of the pinching plate 142 and the pinch surface 127 of the spring pad 126, as shown in FIGS. 31 and 32.

Figure 33:
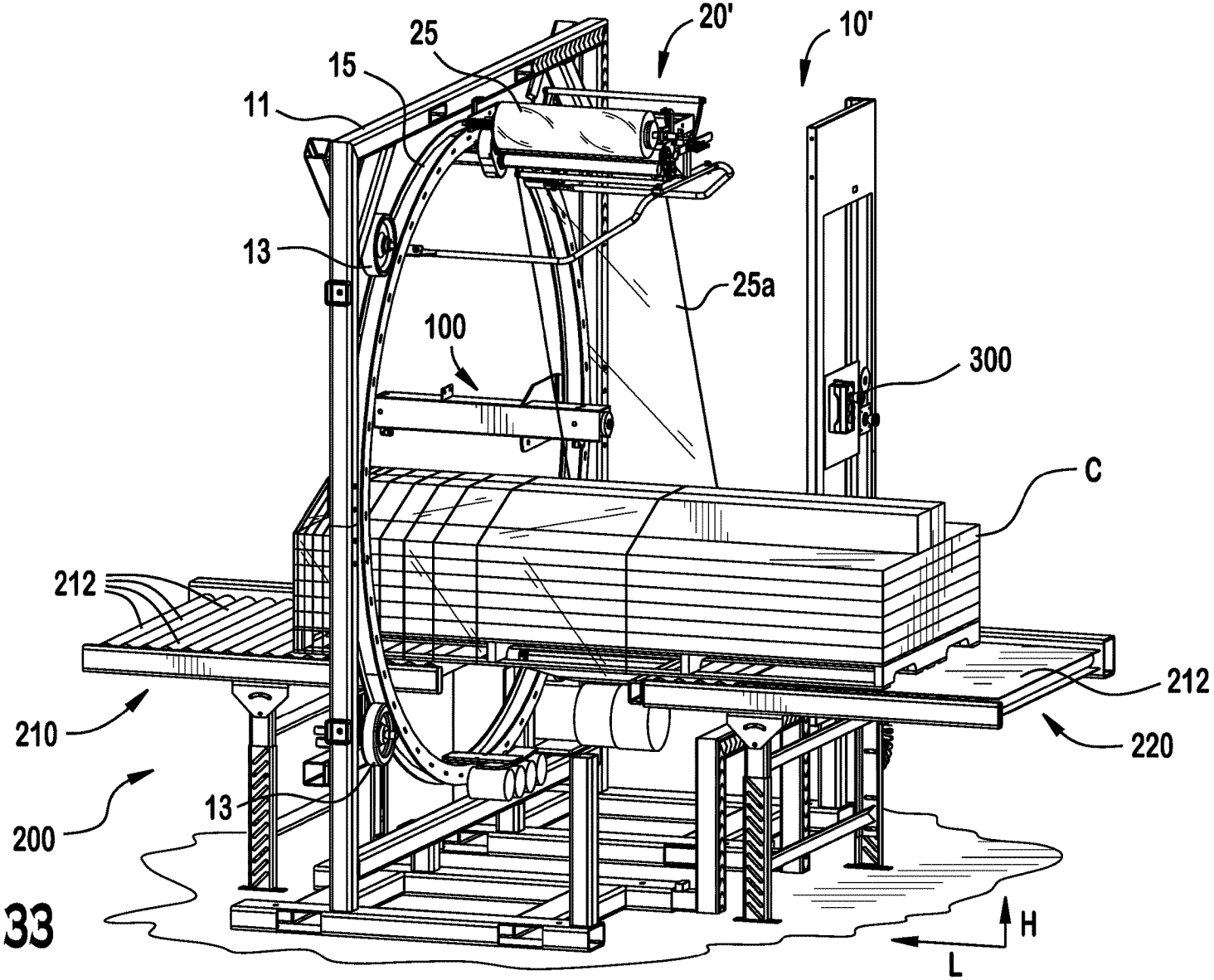
FIG. 33 is a perspective view of the orbital wrapping apparatus of FIG. 22 with a conveyer assembly.
Figure 34:
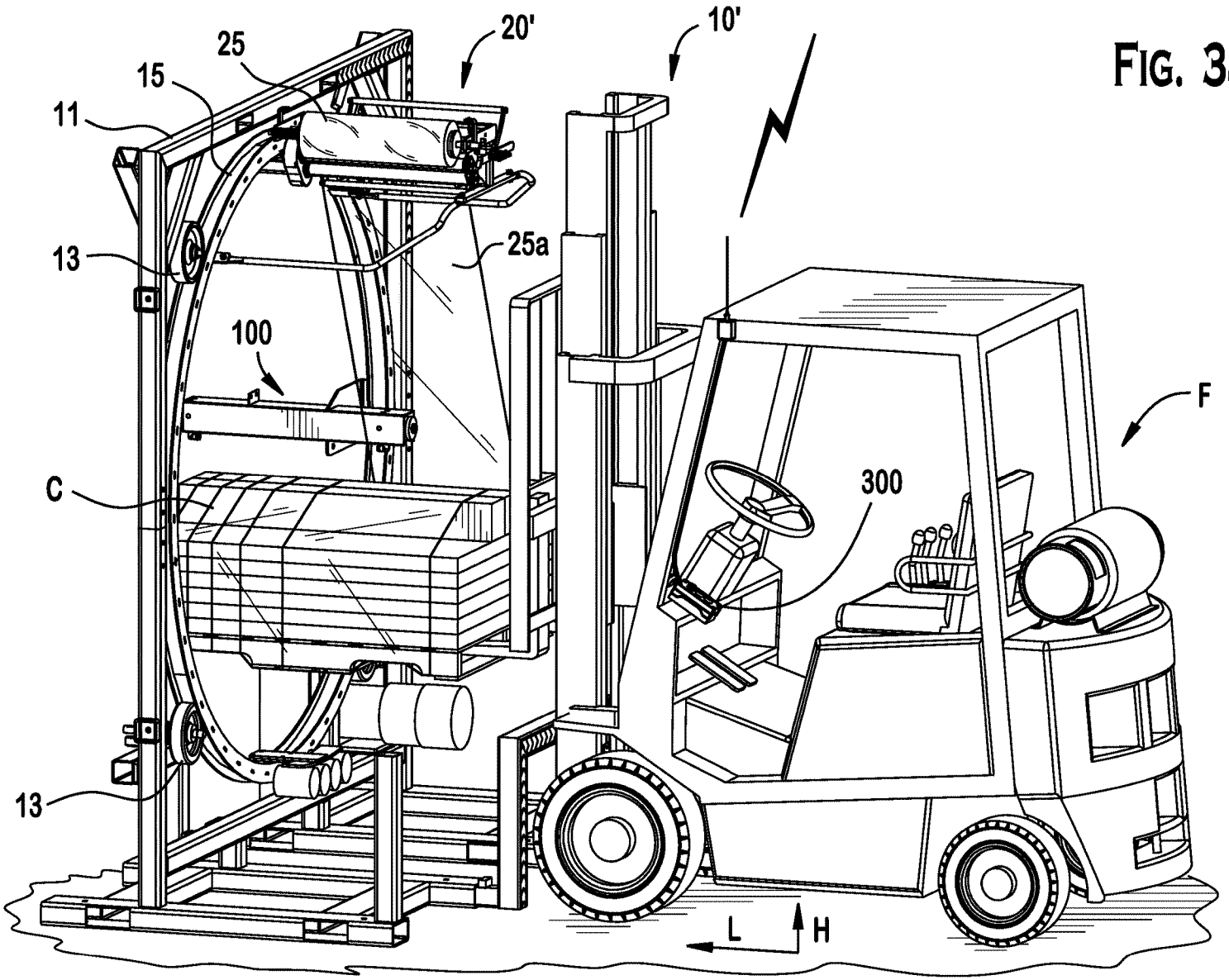
FIG. 34 is a perspective view of the orbital wrapping apparatus of FIG. 22 with a forklift.

After the initial preparation of the orbital wrapping apparatus 10', the cargo C is inserted into the ring assembly 15 and wrapped as shown in FIGS. 32-37. As shown in FIGS. 33 and 34, the cargo C can be inserted into and moved longitudinally with respect to the ring assembly 15 by either a conveyer assembly 200 or a forklift F.

Now with reference to FIGS. 22 and 33, the orbital wrapping apparatus 10' include a conveyer assembly 200 according to the invention.

The conveyer assembly 200, as shown in FIGS. 22 and 33, includes a conveyer support 210 and a conveyer feed 220. The conveyer support 210 includes a plurality of conveyer rollers 214. The conveyer feed 220 includes a conveyer belt 212, a plurality of conveyer rollers 214, and a conveyer bridge 216. The conveyer belt 212 and the conveyer bridge 216 are powered and capable of moving the cargo C along the longitudinal direction L. The conveyer bridge 216 is positioned to extend through the ring assembly 15 and form a nearly continuous support surface for the cargo C. The conveyer rollers 214, 214 roll with motion of the cargo C in the longitudinal direction L.

With an end of the cargo C inserted into the ring assembly 15, the orbital wrapping apparatus 10' begins the wrapping process described above in which the stretch film dispenser 20' is rotated around the cargo C by the drive wheel 13*a*. The stretch film dispenser 20' completes one rotation about a leading end of the cargo C with the stretch film 25*a* still retained by the cutting assembly 100. After the full rotation, the cutting motor 110 moves the shaft 130 out to the extended position and back to the retracted position, releasing the end of the stretch film 25*a*. In an exemplary embodiment of the invention, the orbital wrapping apparatus 10' completes five full rotations, wrapping five layers of stretch film 25*a* around the leading end of the cargo C before the cargo C is moved further along the longitudinal direction L. The number of rotations, number of corresponding layers of stretch film 25*a*, and location of the additional layers may vary in various embodiments.

Figure 35:
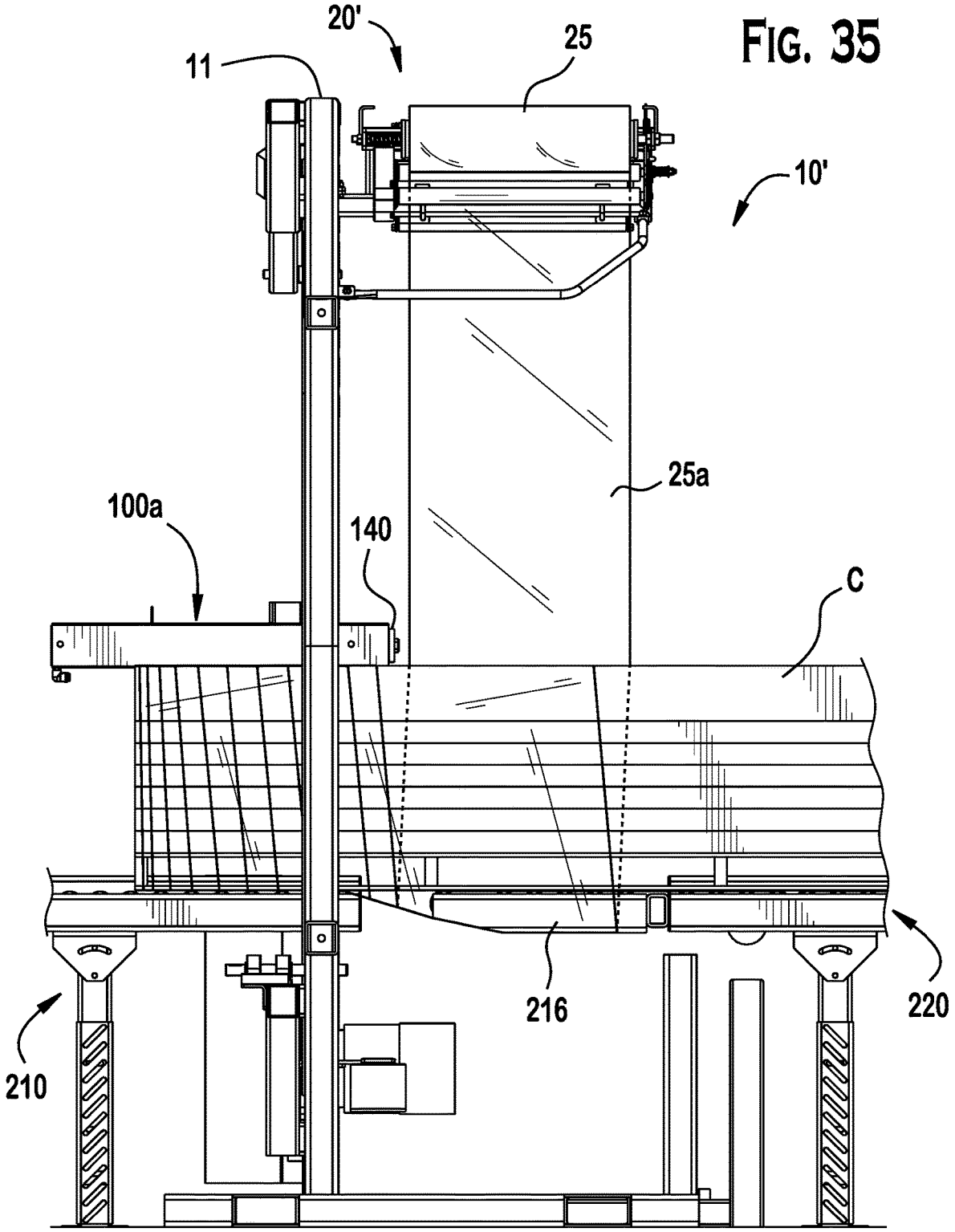
FIG. 35 is a side view of the orbital wrapping apparatus of FIG. 22 wrapping the cargo with the cutting assembly in the retracted position.

As shown in FIGS. 33-35, the conveyer assembly 200 or the forklift F then moves the cargo C along the longitudinal direction L while the orbital wrapping apparatus 10' continues to rotate and the shaft 130 remains in the retracted position. As described above, the differentially rotated feed rollers 30, 35 of the stretch film dispenser 20' keep the stretch film 25*a* taut as the stretch film 25*a* is wrapped around the cargo C. In an exemplary embodiment of the invention shown in FIG. 35 using the conveyer assembly 200, the stretch film 25*a* is additionally wrapped around the conveyer bridge 216 and shrinks to the cargo C after passing the conveyer bridge 216 due to the tension in the stretch film 25*a*.

In an exemplary embodiment of the invention, the orbital wrapping apparatus 10' will only rotate when a safety button 300 is actively pressed. As shown in FIGS. 33 and 34, in various embodiments the safety button 300 may be attached to the base frame 11 or may be on the forklift F. The safety button 300 may alternatively be located at any position that places the user out of reach of the orbital wrapping apparatus 10'.

The tension assembly 80 is used In an exemplary embodiment of the invention in which the cargo C has a low profile or a relatively small height in a height direction H. To use the tension assembly 80, a user additionally feeds the stretch film 25*a* over the third feed roller 82, through the tension frame 85, and under the fourth feed roller 84 as shown in FIG. 26. The third feed roller 82 and the fourth feed roller 84 rotate at a third speed faster than the speed of the first feed roller 30 and the speed of the second feed roller 35 while the pivot spring 87 maintains tension on the stretch film 25*a* at a position closer to the low-profile cargo C.

In an exemplary embodiment of the invention, the orbital wrapping apparatus 10' completes five full rotations at a central location between the leading end and a trailing end of the cargo and also completes five full rotations at the trailing end of the cargo C. The number of rotations, number of corresponding layers of stretch film 25*a*, and location of the additional layers may vary in various embodiments.

Figure 36:
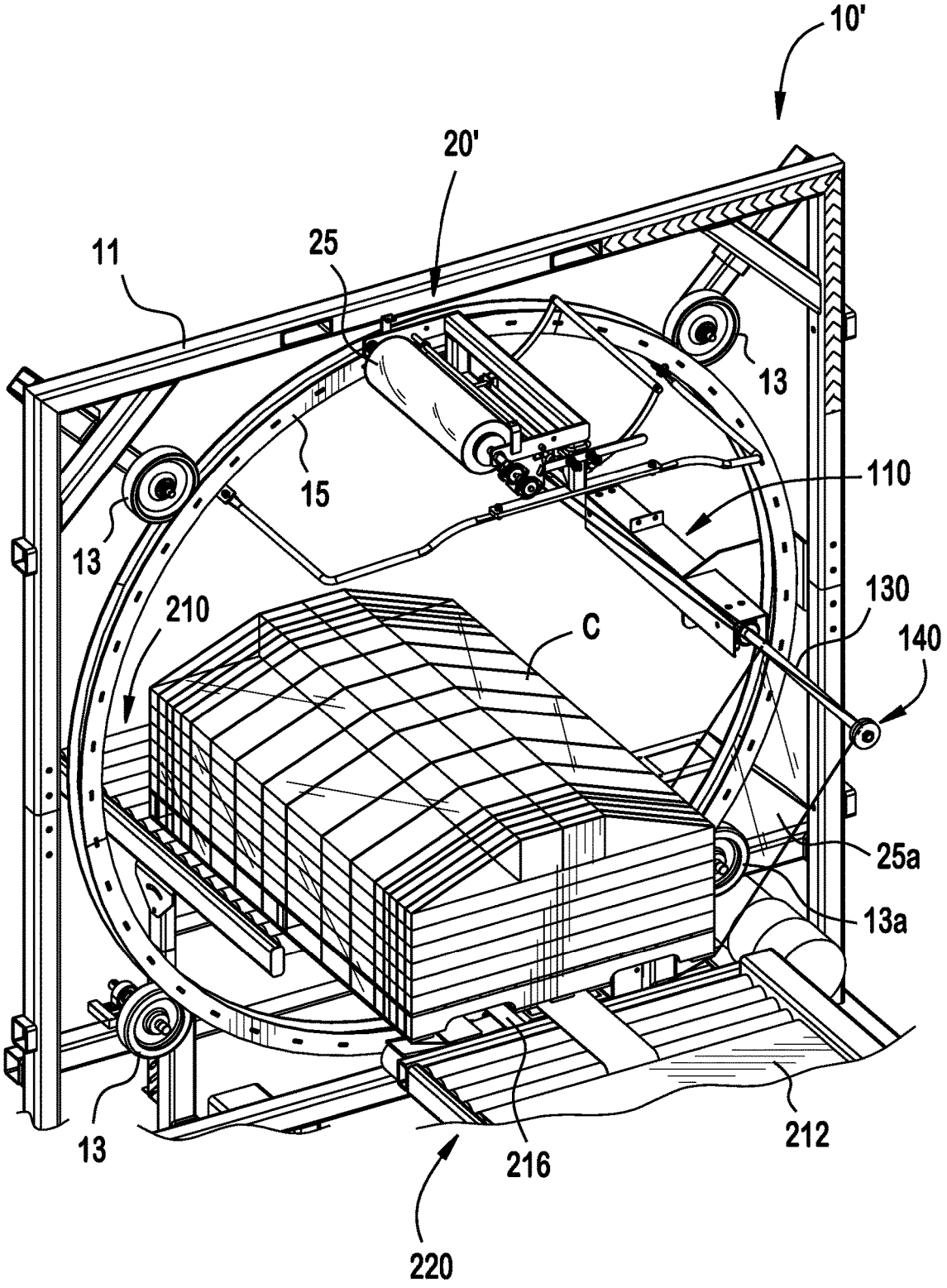
FIG. 36 is a perspective view of the orbital wrapping apparatus of FIG. 22 wrapping the cargo with the cutting assembly in the extended position.
Figure 37:
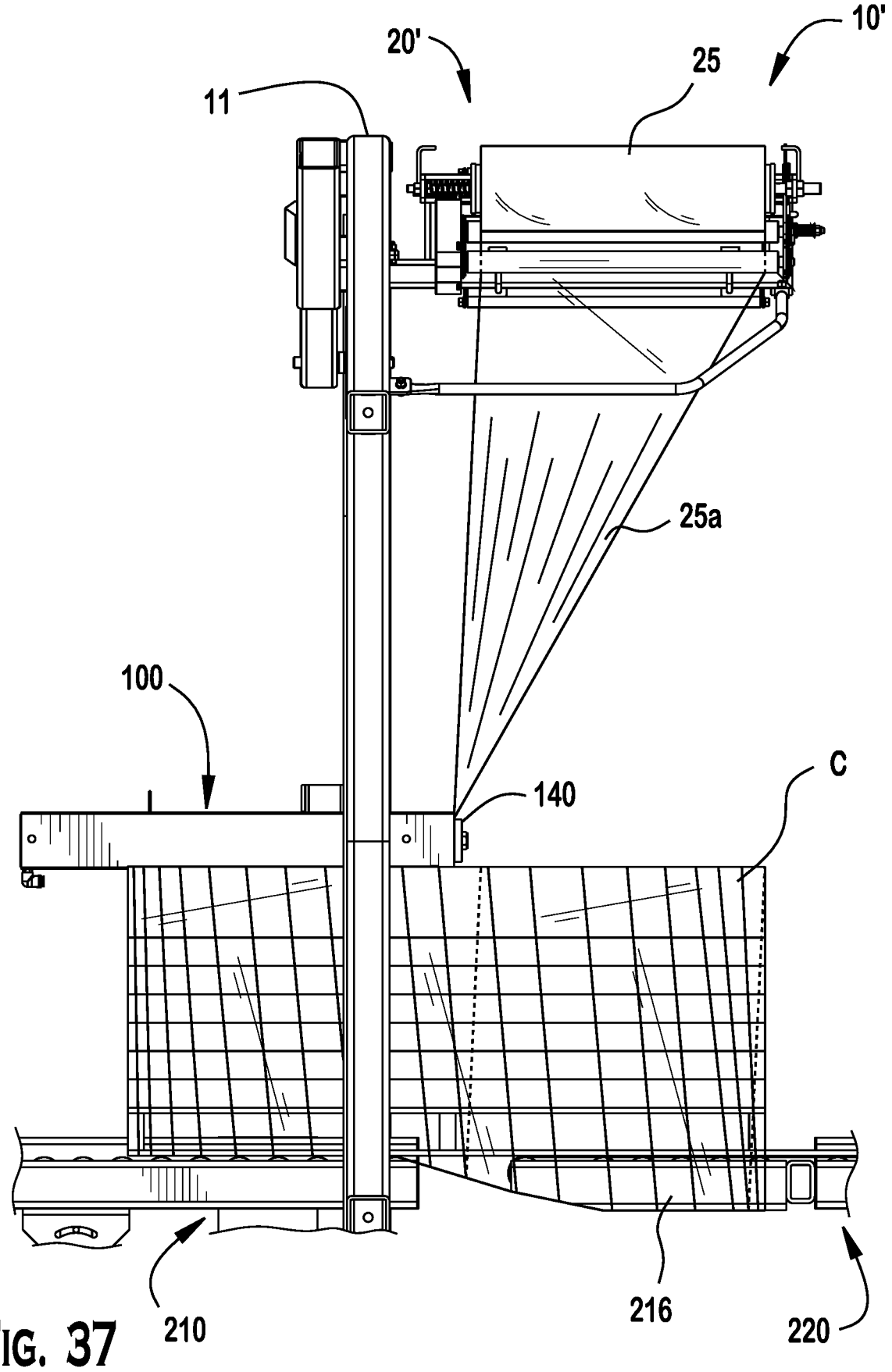
FIG. 37 is a side view of the orbital wrapping apparatus of FIG. 22 with the cutting assembly holding a stretch film.

In a final rotation of the orbital wrapping apparatus 10' about the trailing end of the cargo C, the cutting motor 110 moves the shaft 130 to the extended position and the stretch film 25*a* is positioned around the shaft 130 by the rotation of the stretch film dispenser 20' as shown in FIG. 36. In a same process as described above with respect to FIGS. 29-32, the cutting motor 110 then moves the shaft 130 into the retracted position shown in FIG. 37, severing the stretch film 25*a* wrapped around the cargo C and holding the portion of the stretch film 25*a* connected to the roll 25 of stretch film. The wrapped cargo C can then be withdrawn from the orbital wrapping apparatus 10' for subsequent shipping and the orbital wrapping apparatus 10' is prepared to wrap another piece of cargo C.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

What is claimed is:

1. An orbital wrapping apparatus for wrapping a cargo in a stretch film, comprising:

a base frame;

a circular ring assembly mounted on the base frame and rotatable with respect to the base frame to form an axis of rotation;

a stretch film dispenser mounted on the circular ring assembly and rotatable with the circular ring assembly about the axis of rotation, the stretch film dispenser having:

a roll of stretch film dispensing the stretch film by rotation of the circular ring assembly;

a subframe fixed to the circular ring assembly and the roll of stretch film is mounted on a loading assembly attached to the subframe, the loading assembly having:

a first end cap having a fixed position with respect to the subframe;

a second end cap movable with respect to the subframe and the roll of stretch film held between the first end cap and the second end cap; and a lever attached to and pivotable with respect to the subframe, the lever adapted to engage a protrusion of the portion of the subframe to hold the portion of the subframe in a second position; a first feed roller and a second feed roller are mounted to a portion of the subframe that is movable between a first position adjacent to an axis extending through the first and second end caps and the second position spaced further apart from the axis; and a cutting assembly, the cutting assembly includes a cutting motor, a cutter head attached to the cutting motor, a shaft movable by the cutting motor between a retracted position and an extended position, and a pinch head attached to an end of the shaft, the cutter head includes a cutter housing and a spring pad disposed within the cutter housing and movable with respect to the cutter housing between a depressed position and a protruding position, mounted to the base frame and extending through an opening defined by the circular ring assembly, the cutting assembly adapted to cut and hold the stretch film.

2. The orbital wrapping apparatus of claim 1, wherein the loading assembly includes a subframe spring biasing the portion of the subframe toward the second position.

3. The orbital wrapping apparatus of claim 1, wherein the cutter head includes a blade attached to an outer surface of the cutter housing.

4. The orbital wrapping apparatus of claim 1, wherein a plurality of springs are disposed between the spring pad and the cutter housing and bias the spring pad into the protruding position.

5. The orbital wrapping apparatus of claim 1, wherein, in the protruding position, a pinch surface of the spring pad is positioned beyond a sharp edge of the blade in a longitudinal direction of the shaft, and in the depressed position, the sharp edge of the blade is positioned beyond the pinch surface of the spring pad in the longitudinal direction of the shaft.

6. The orbital wrapping apparatus of claim 5, wherein the stretch film is held between a pinch surface of the pinching plate and the spring pad when the shaft is in the retracted position.

7. The orbital wrapping apparatus of claim 6, wherein the pinching plate is formed of a nylon material and the support plate is formed of a metal material.

8. The orbital wrapping apparatus of claim 1, wherein a pinching plate of the pinch head abuts a sharp edge of the blade when the shaft is in the retracted position.

9. The orbital wrapping apparatus of claim 8, wherein the pinch head includes a support plate abutting a surface of the pinching plate opposite the pinch surface.

10. The orbital wrapping apparatus of claim 1, wherein the shaft has a non-stick coating.

11. The orbital wrapping apparatus of claim 1, wherein the first feed roller and the second feed roller are mounted to the portion of the subframe and the stretch film dispenser has a tension assembly attached to the subframe, the tension assembly including a third feed roller and a fourth feed roller.

12. The orbital wrapping apparatus of claim 11, wherein the third feed roller is mounted adjacent to the subframe and the fourth feed roller is mounted on an end of a tension frame and is spaced apart from the subframe.

13. The orbital wrapping apparatus of claim 12, wherein the tension frame is pivotable with respect to the subframe between a first position closer to the roll of stretch film and a second position further from the roll of stretch film.

14. The orbital wrapping apparatus of claim 11, wherein the first feed roller engages the stretch film and rotates at a first speed during rotation of the circular ring assembly at a set speed and the second feed roller engages the stretch film and rotates at a second speed faster than the first speed during rotation of the circular ring assembly at the set speed.

15. The orbital wrapping apparatus of claim 14, wherein the third and fourth feed rollers engage the stretch film and rotate at a third speed faster than the second speed during rotation of the circular ring assembly at the set speed.

16. An orbital wrapping apparatus for wrapping a cargo in a stretch film, comprising:

a base frame;

a circular ring assembly mounted on the base frame and rotatable with respect to the base frame to form an axis of rotation;

a stretch film dispenser mounted on the circular ring assembly and rotatable with the circular ring assembly about the axis of rotation, the stretch film dispenser having:

a roll of stretch film dispensing the stretch film by rotation of the circular ring assembly;

a subframe;

a loading assembly having:

a first end cap having a fixed position with respect to the subframe;

a second end cap movable with respect to the subframe and the roll of stretch film held between the first end cap and the second end cap; and a lever attached to and pivotable with respect to the subframe, the lever adapted to engage a protrusion of the portion of the subframe to hold the portion of the subframe in a second position; a first feed roller and a second feed roller are mounted to a portion of the subframe that is movable between a first position adjacent to an axis extending through the first and second end caps and the second position spaced further apart from the axis; and a cutting assembly, the cutting assembly includes a cutting motor, a cutter head attached to the cutting motor, a shaft movable by the cutting motor between a retracted position and an extended position, and a pinch head attached to an end of the shaft, the shaft has a non-stick coating mounted to the base frame and extending through an opening defined by the circular ring assembly, the cutting assembly adapted to cut and hold the stretch film.

17. The orbital wrapping apparatus of claim 16, wherein the stretch film dispenser has the subframe fixed to the circular ring assembly and the roll of stretch film is mounted on the loading assembly attached to the subframe.

* * * * *